US005368320A

United States Patent [19]

Teeter et al.

[11] Patent Number: 5,368,320

[45] Date of Patent: * Nov. 29, 1994

[54] AUTOMATICALLY RELEASING SKI BINDING

[75] Inventors: Roger C. Teeter; Lawrence C. Smith, both of Sumner, Wash.

[73] Assignee: STL International, Incorporated, Tacoma, Wash.

[ * ] Notice: The portion of the term of this patent subsequent to Oct. 22, 2008 has been disclaimed.

[21] Appl. No.: 617,837

[22] Filed: Nov. 26, 1990

Related U.S. Application Data

[63] Continuation-in-part of Ser. No. 394,701, Aug. 16, 1989, Pat. No. 5,056,803, which is a continuation-in-part of Ser. No. 169,789, Mar. 18, 1988, Pat. No. 5,058,910.

[51] Int. Cl.[5] ..... A63C 9/08

[52] U.S. Cl. ..... 280/14.2; 280/617; 280/623; 441/70

[58] Field of Search ..... 280/615, 616, 617, 618, 280/623, 14.2, 634; 441/70

[56] References Cited

U.S. PATENT DOCUMENTS

| | | | |
|---|---|---|---|
| 3,731,328 | 5/1973 | Russell | 441/70 |
| 4,652,007 | 3/1987 | Dennis | 280/618 |
| 4,681,337 | 7/1987 | Bolton | 280/615 |
| 4,784,233 | 11/1988 | Favors | 280/14.2 |
| 5,029,890 | 7/1991 | Pfaffenbichler et al. | 280/634 |
| 5,056,803 | 10/1991 | Teeter et al. | 280/14.2 |
| 5,058,910 | 10/1991 | Teeter et al. | 280/14.2 |

*Primary Examiner*—Richard M. Camby
*Attorney, Agent, or Firm*—Robert W. Beach

[57] ABSTRACT

A binding for two feet in tandem on one ski that includes a boot for holding the front foot having a detachable toe holder and keeper member secured to the ski between the two feet for holding the forward boot heel. A further engageable member for the rear foot holds the keeper member for the heel of the forward boot when the rear foot is in position on the ski and releases the keeper member to free the forward boot heel should the rear foot be removed from the ski.

17 Claims, 20 Drawing Sheets

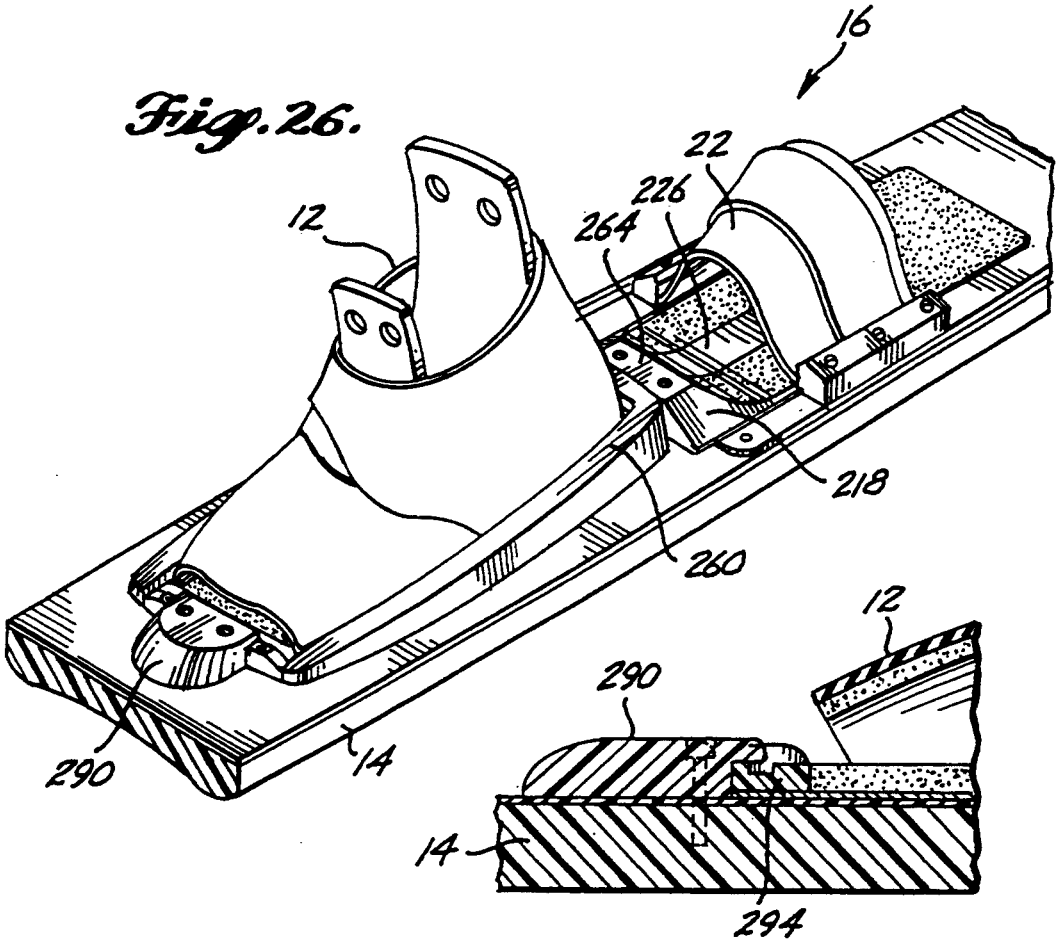
Fig. 26.
Fig. 27.
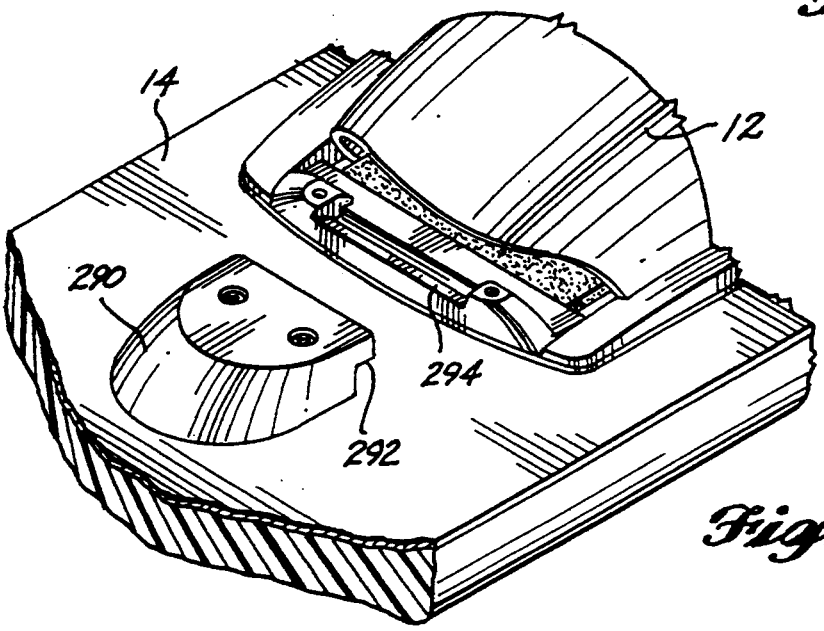
Fig. 28.

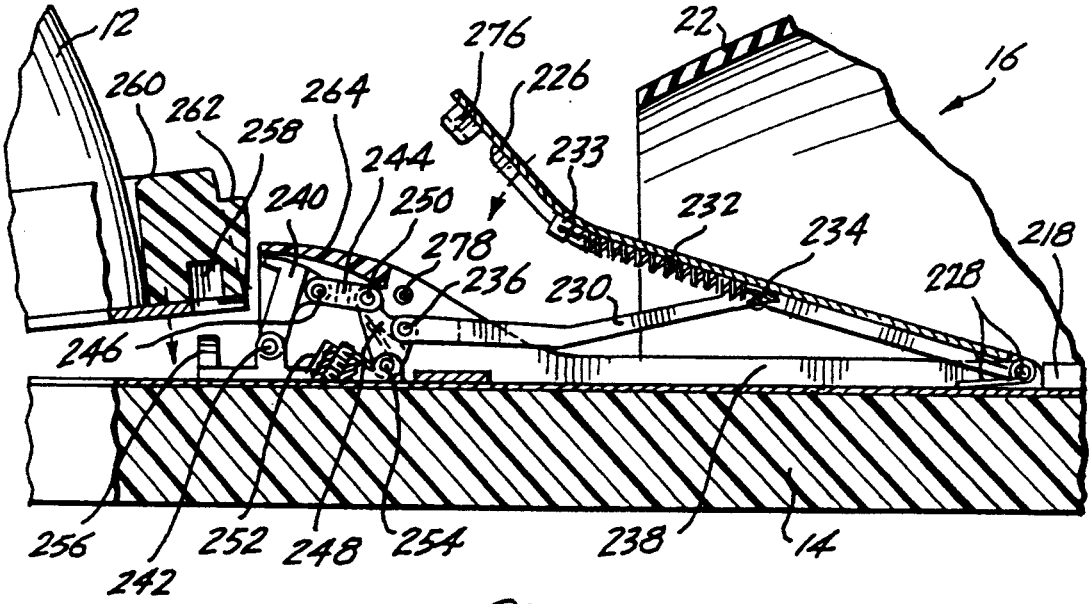
Fig. 29.
Fig. 31.
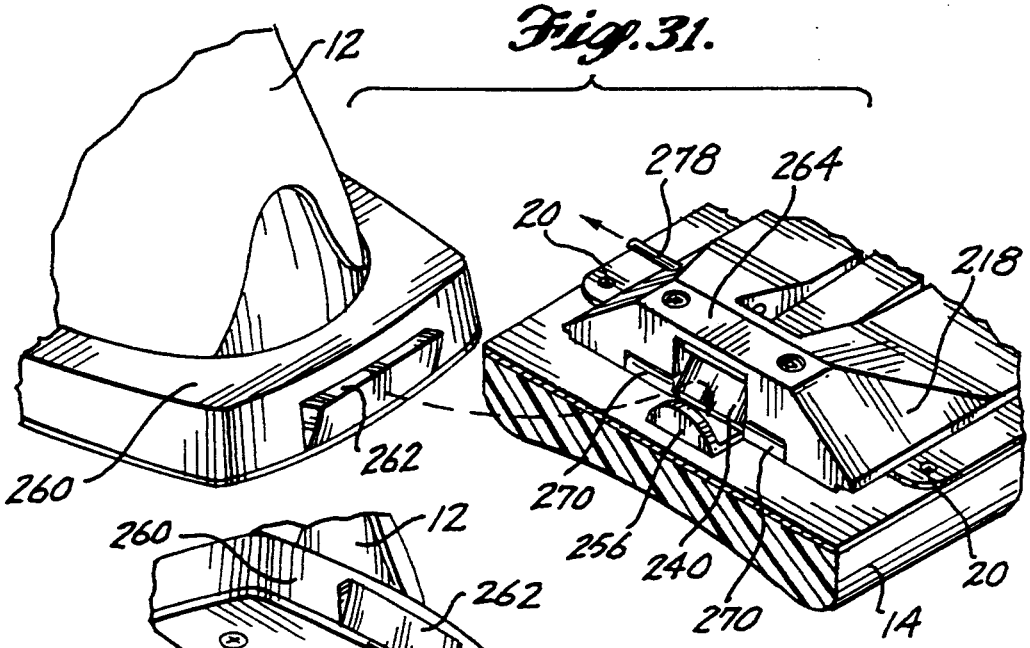
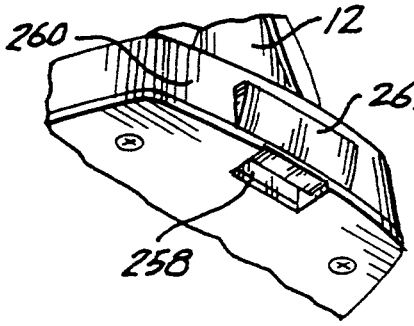
Fig. 32.

Fig. 30.
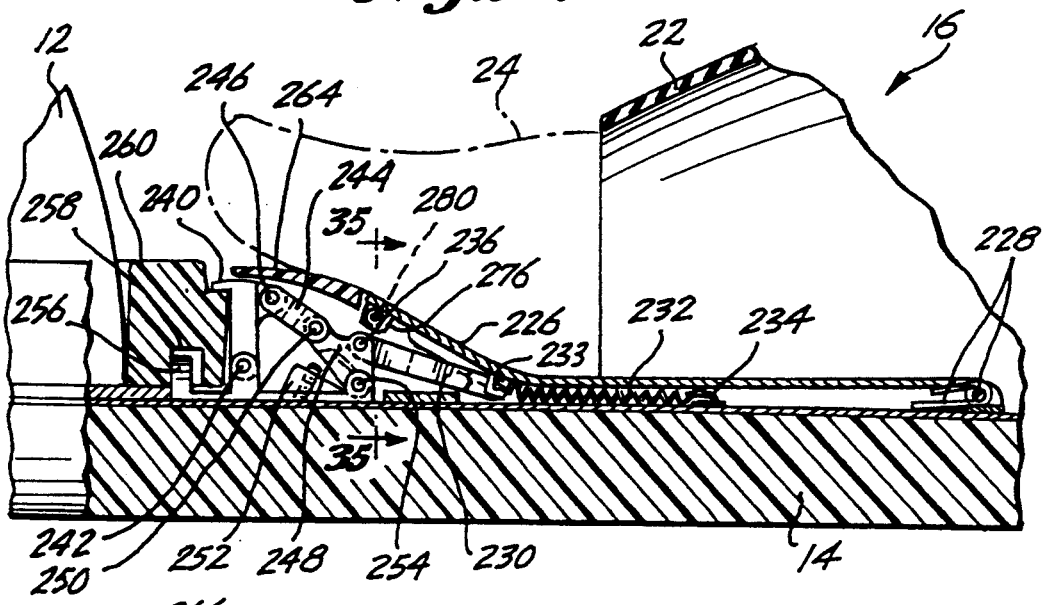
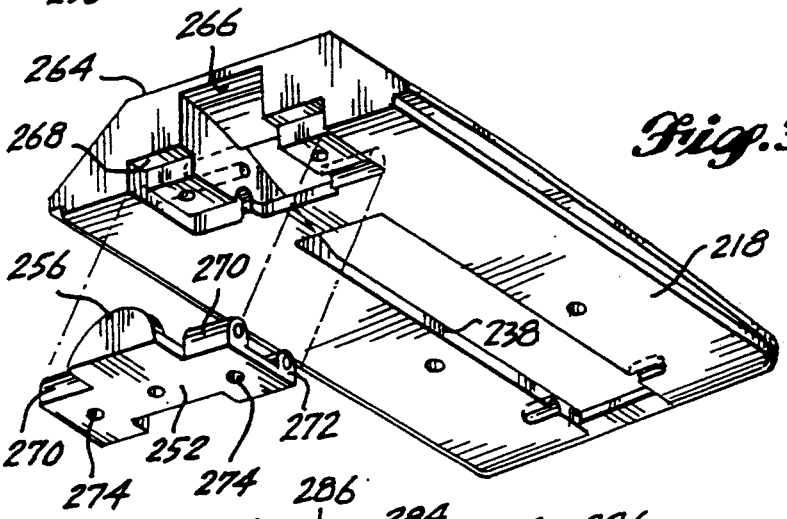
Fig. 34.
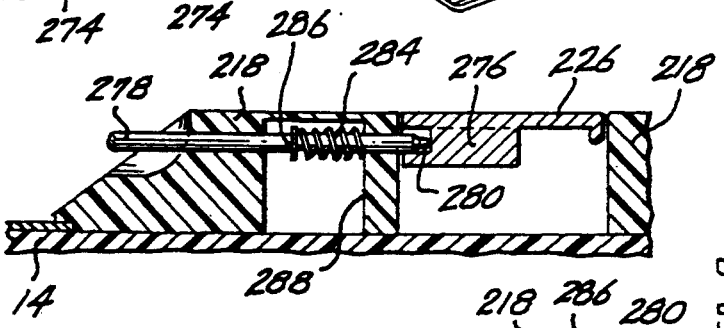
Fig. 35.
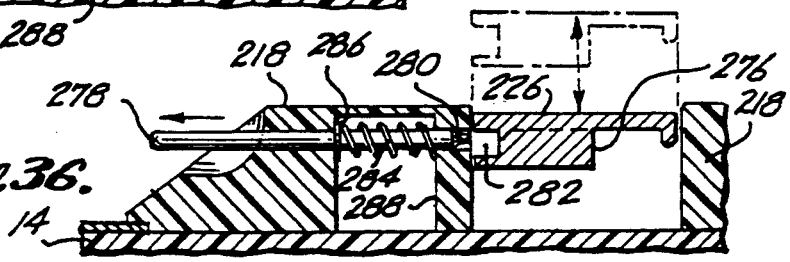
Fig. 36.

Fig. 40.
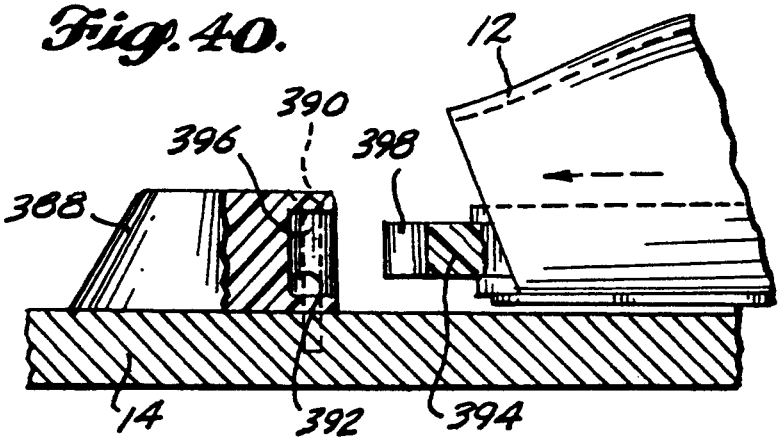
Fig. 43.
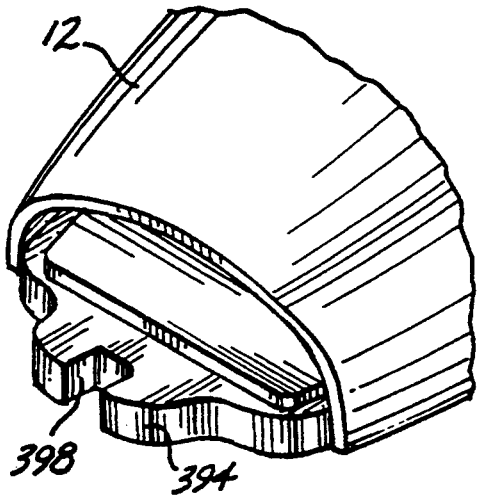
Fig. 42.
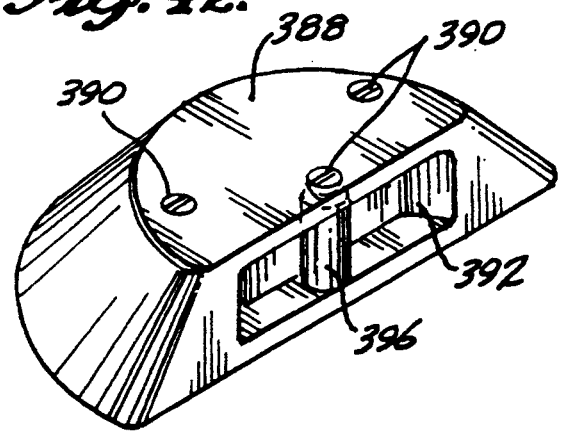
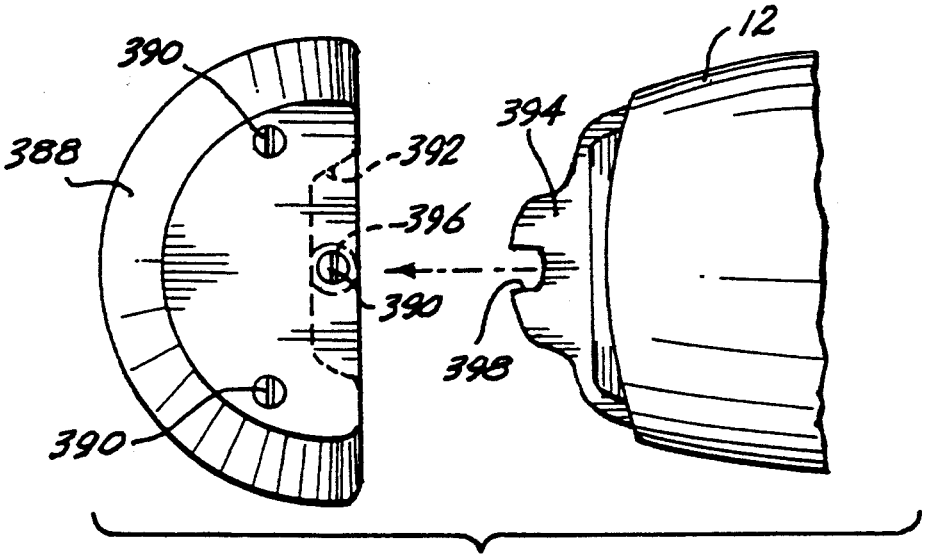
Fig. 41.

AUTOMATICALLY RELEASING SKI BINDING

CROSS REFERENCE

This application is a continuation-in-part of our copending U.S. patent application Ser. No. 07/394,701, filed Aug. 16, 1989, for Automatically Releasing Ski Binding, U.S. Pat. No. 5,056,803 which is a continuation-in-part of our copending U.S. patent application Ser. No. 169,789, filed Mar. 18, 1988, for Automatically Releasing Ski Binding, U.S. Pat. No. 5,058,910.

BACKGROUND OF THE INVENTION

1. Field of the Invention

This invention relates to foot-retaining ski bindings for feet arranged in tandem, particularly on a single water ski.

2. Prior Art

When skiing one may use a single ski and place the feet on the ski in tandem arrangement, one foot behind the other. A water ski providing for such foot placement is shown in Russell U.S. Pat. No. 3,731,328, issued May 8, 1973.

It has been found that much better control of the ski is provided i f at least the front foot is firmly held to the ski. If for any reason the skier falls, frequently his rear foot comes loose from the ski and his front foot remains attached to the ski, which could cause severe injury. This situation is particularly apt to occur when the front foot is held in a forward boot attached to the ski and the rear foot is simply held by an instep strap, so that the rear foot can be pulled out of the strap when the skier falls and the front foot is still held by the boot to the ski. If the skier prefers to have both feet fitted in boots, then in a fall one foot could be pulled out of a boot to free only one foot. If the other foot remained in a boot attached to the ski, severe injury could result.

U. S. Dennis Pat. No. 4,652,007, issued Mar. 24, 1987, for Releasable Binding System for Snowboarding discloses a binding for two feet on a snowboard constructed for automatic and simultaneous release of one foot when the other foot is released from the snowboard.

SUMMARY OF THE INVENTION

The principal object of this invention is to insure that where two feet are in tandem arrangement on the same ski, whenever one foot is separated from the ski the other foot is automatically released from the ski.

Specifically it is an object to provide release of the front foot from a ski should the rear foot be separated from the same ski.

It is another object to secure a front foot by a forward boot in place on a ski until the rear foot is retained on the same ski.

To accomplish the foregoing objects, a forward boot is secured at the toe and the heel to a ski. The toe of the boot on the foot is inserted into a front hold-down and the boot heel is held by a movably mounted heel retainer kept in a forward position by a holding member located behind the heel retainer. When the rear foot is separated from the ski the holding member is released so that the front foot boot heel retainer is freed to move rearward and release the front foot boot from the ski. When the retainer for the rear foot is another boot, that boot has an excessive force release device holding the heel of that boot to the ski. When the rear foot retainer includes an instep strap secured to the ski a treadle under the strap is held depressed by the ball of the rear foot to hold the front foot boot heel retainer forward, and such treadle is released if the rear foot is removed from beneath the strap to enable the front foot boot heel retainer holding member to release the front boot heel retainer.

DESCRIPTION OF THE DRAWINGS

FIG. 26 is a top perspective of a third embodiment of the invention.

FIG. 27 is a longitudinal section through the forward portion of the invention shown in FIG. 26 with parts in assembled relationship, and FIG. 28 is a top perspective of the same portion of the invention with parts in separated relationship.

FIG. 29 is an enlarged longitudinal section through the central portion of the invention shown in FIG. 26 with parts in one relationship, and FIG. 30 is a similar view with parts in a different relationship.

FIG. 31 is a top perspective of portions of the third embodiment of the invention shown in FIGS. 29 and 30 with components shown in exploded relationship, and FIG. 32 is a bottom perspective of one of the components shown in FIG. 31.

FIG. 34 is a bottom perspective of a component of the third embodiment of the invention shown in FIGS. 29, 30 and 31 with parts shown in exploded relationship.

FIG. 35 is a detail transverse section through a portion of the mechanism of the third embodiment of the invent ion shown in FIGS. 29 and 30 with parts in latched relationship, and FIG. 36 is a similar view with parts shown in unlatched relationship.

FIG. 40 is a fragmentary side elevation of a portion of the ski binding shown in FIG. 38 with parts broken away and showing interengageable components in separated relationship, and FIG. 41 is a top plan of the components shown in FIG. 40 also in separated relationship.

FIG. 42 is a rear top perspective of one of the components shown in FIGS. 40 and 41, and FIG. 43 is a front top perspective of the other component shown in FIGS. 40 and 41.

DETAILED DESCRIPTION

Figure 5:
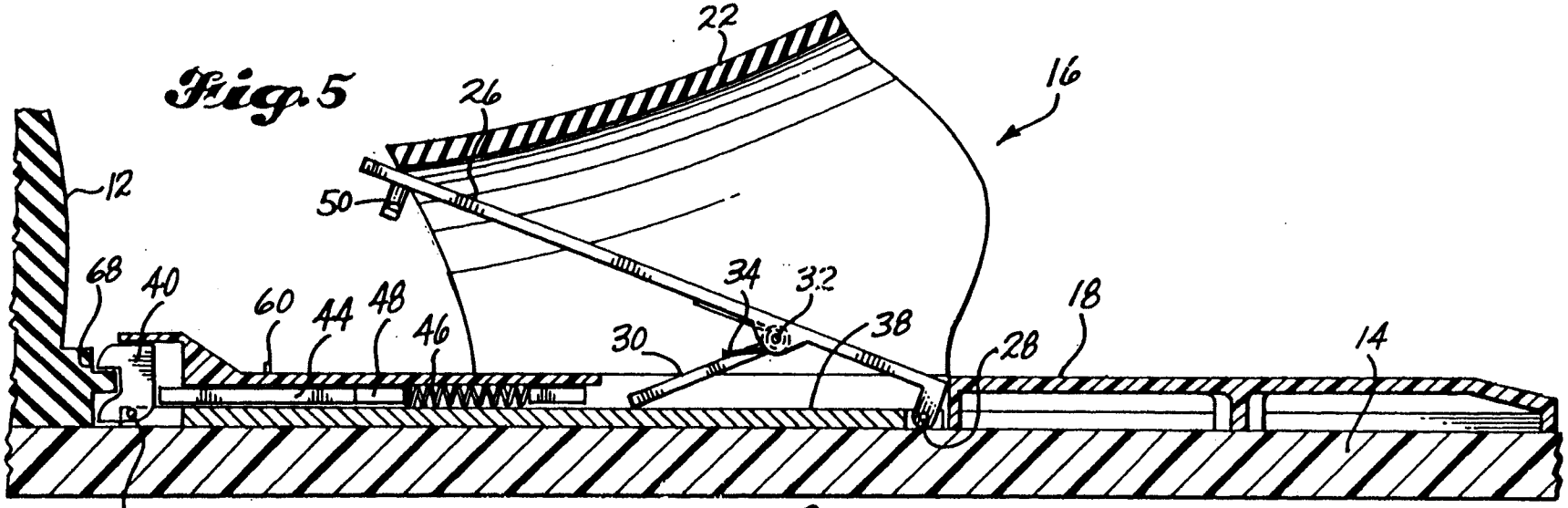
FIGS. 5 and 6 are longitudinal sections taken along line 5—5 of FIG. 4, FIG. 5 showing the binding in released position and FIG. 6 showing the binding in holding position with a foot in place.
Figure 6:
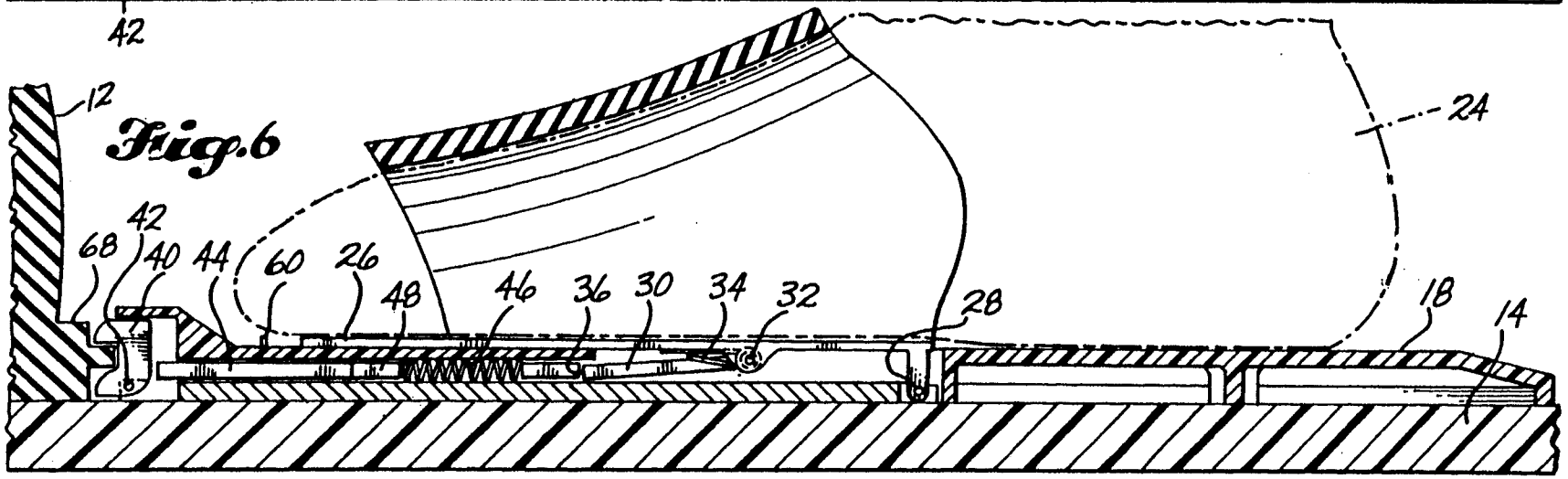

As shown in the form of the invention illustrated in FIGS. 1 to 15, a ski binding 10 has a foot-engaging member in the form of a forward foot-holding boot 12 for a front foot releasably mounted on a ski 14, shown as a water ski, and a rearward foot-engaging member 16 on the same ski for holding the rear foot. The rearward foot-engaging member has a base 18 secured to the ski with fasteners 20. A foot-holding instep strap 22 is secured to the base and is located to receive and hold the front portion of the rear foot 24 shown in broken lines in FIG. 4. A foot lever or pedal or treadle 26, shown in FIGS. 5 and 6, is pivotally mounted by pin 28 to the base 18 and extends forward from such pin. A thrust arm 30 beneath the treadle 26 has its rearward end pivotally mounted by pivot pin 32 to the underside of the treadle. A torsion spring 34 is mounted on pin 32 in a manner to swing treadle 26 upward due to the end 36 of the thrust arm 30 pressing against the upper surface 38 of base 18 when there is no downward pressure by the foot 24 against the treadle.

Figure 7:
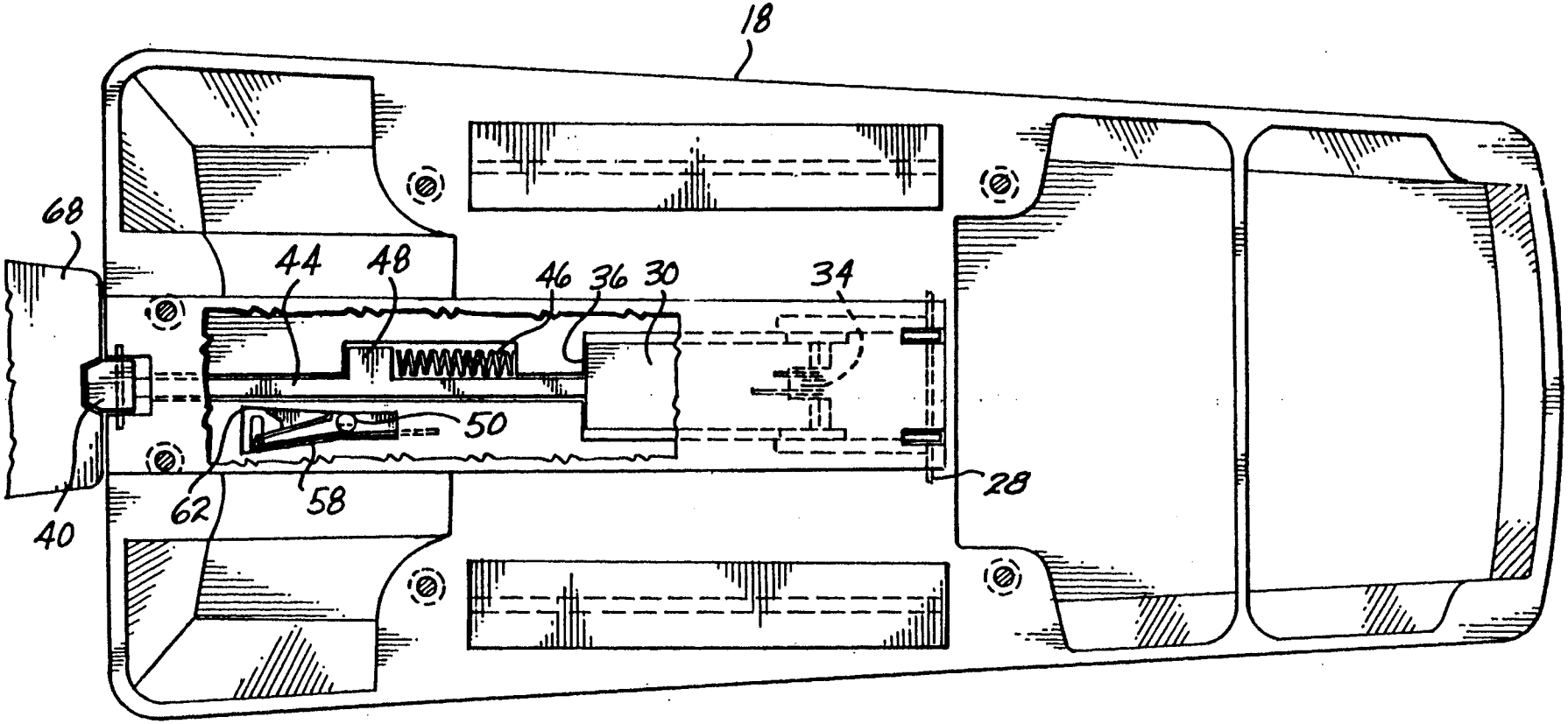
FIG. 7 is a bottom plan of FIG. 4 with parts broken away.
Figure 8:
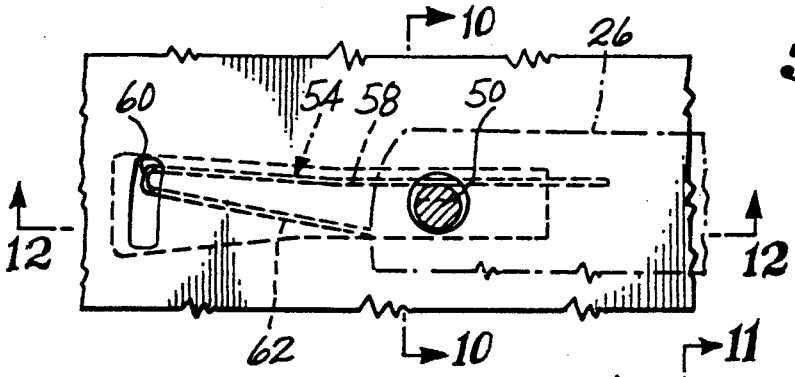
FIG. 8 is a detailed plan of hold-down parts in position ready to be latched in place.

A latch hook keeper 40 is pivotally mounted by pin 42 to the front end of base 18 so as to be held against translation lengthwise of the ski. In its forwardly swung position the hook of such keeper will engage a projection 68 carried by the heel of front boot 12 to hold such heel to the ski. A slide bar 44 is slidably mounted on the base and is located and is of a length to extend between the latch hook keeper 40 and the forward end 36 of thrust arm 30 to hold the keeper positively in forwardly swung latching position when the treadle 26 is held down as shown in FIG. 5 such as by the rear foot inserted under instep strap 22. A weak helical compression spring 46 is mounted between base 18 and a projection 48 extending laterally from slide bar 44, as shown in FIG. 7, to urge such bar forwardly against latch hook keeper 40 when it is not held positively by slide bar 44, as shown in FIG. 5. Lifting of the heel of the forward boot 12 when the keeper is not positively held in latched position would cause heel projection 68 to lift the hook of such keeper and swing the keeper rearward from the position shown in FIG. 5 into released or unlatched position, shifting slide bar 44 rearward in opposition to the force of spring 46 since such slide movement is not blocked by thrust arm 30 as in the position of FIG. 6.

The forward end of treadle 26 has beneath it a downwardly extending boss 50, best shown in FIGS. 9 through 12. That boss has a flaring notch 52 in a lateral side of its lower end portion, shown best in FIG. 10. A return bent resilient keeper or latch wire 54 is received in a recess 56 of the base 18 and has a longer latch leg 58 extending alongside the notch 52 in boss 50 and a shorter leg 62. The return bent portion of wire 54 is bent upward at a right angle to the coplanar legs 58 and 62 to form a projection 60 extending upward above the base 18. The shorter leg 62 of the wire presses against the side of the recess 56 adjacent to the side of boss 50 opposite notch 52 so as to act as a spring for moving the longer wire latch leg 58 away from the notch 52 in the boss 50.

Figure 9:
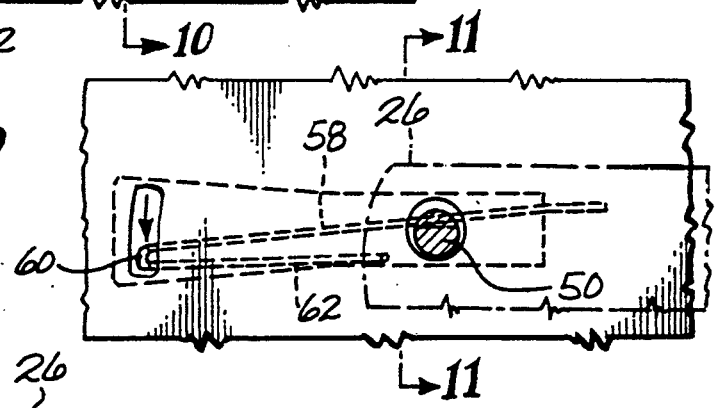
FIG. 9 is a corresponding view with parts in securing position.
Figure 10:
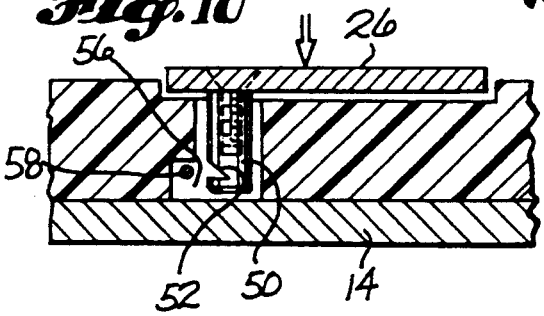
FIG. 10 is a cross section taken along line 10—10 of FIG. 8.
Figure 11:
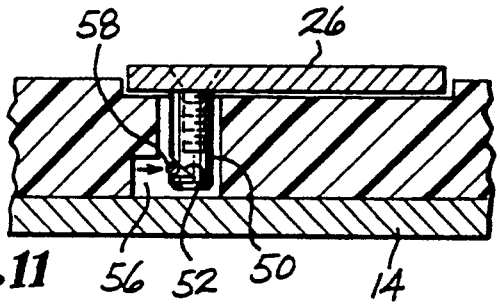
FIG. 11 is a cross section taken along line 11—11 of FIG. 9.
Figure 12:
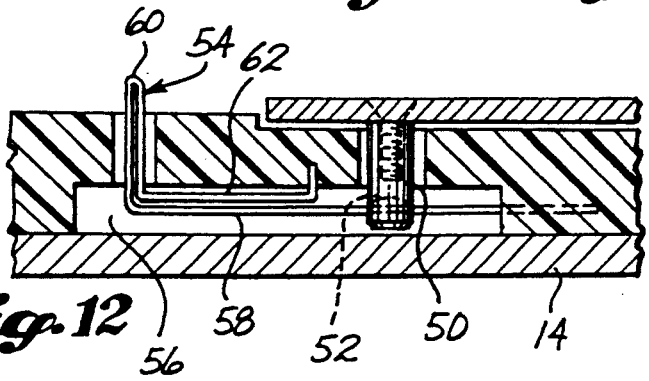
FIG. 12 is a longitudinal section taken along line 12—12 of FIG. 8.

When the treadle 26 is pressed down manually nearly to the base 18 the upwardly extending projection 60 of the wire may be moved manually toward the boss 50 as indicated in FIG. 9 to insert the latch leg 58 into the notch 52 of the boss for latching the treadle 26 in its lower position. If the treadle is then released the latch wire leg 58 will be held frictionally in the notch 52 as shown in FIG. 9 owing to the torsion spring 34 acting on the thrust arm 30 tending to swing treadle 26 upward. When the rear foot 24 is inserted beneath the instep strap 22 it will press the treadle 26 down slightly from its latched position, moving boss 50 down to wedge the wire leg 58 out of boss notch 52 to allow release of the boss. Consequently, when the foot 24 is withdrawn from beneath the instep strap 22, the treadle will be swung upward by spring 34 from the positive keeper-holding position shown in FIG. 6 to that of FIG. 5 in which upward force exerted by projection 68 of the front boot heel will unlatch the keeper 40 by swinging it rearward to release the front boot heel projection 68.

Figure 13:
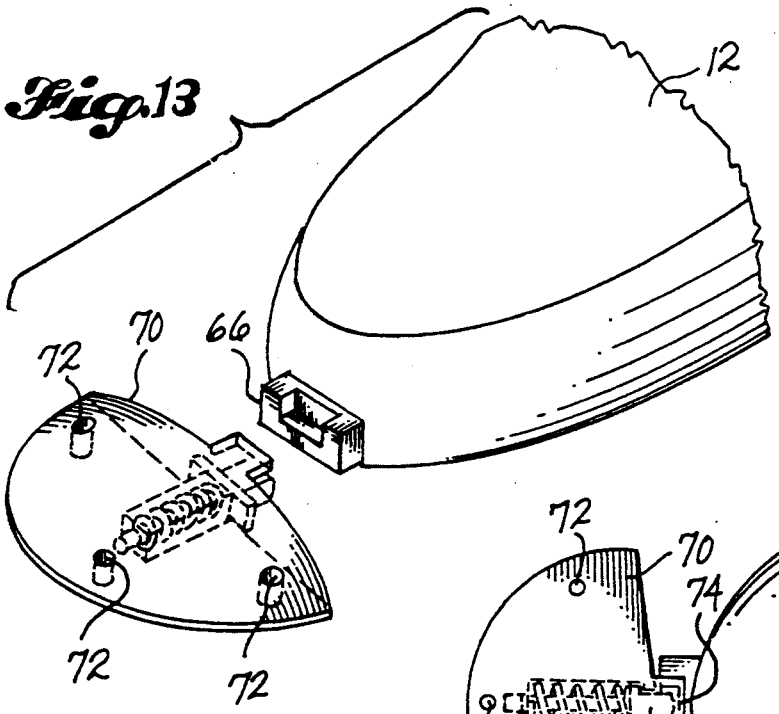
FIG. 13 is a top perspective showing the front boot front hold-down with parts in exploded relationship.
Figure 14:
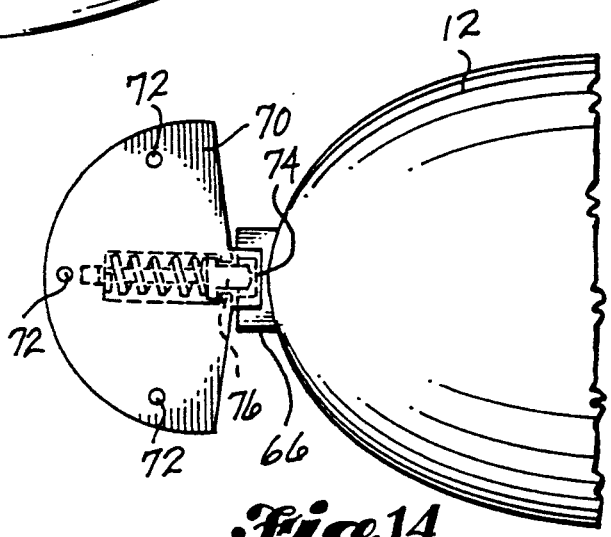
FIG. 14 is a plan of a boot front hold-down with parts in assembled relationship.
Figure 15:
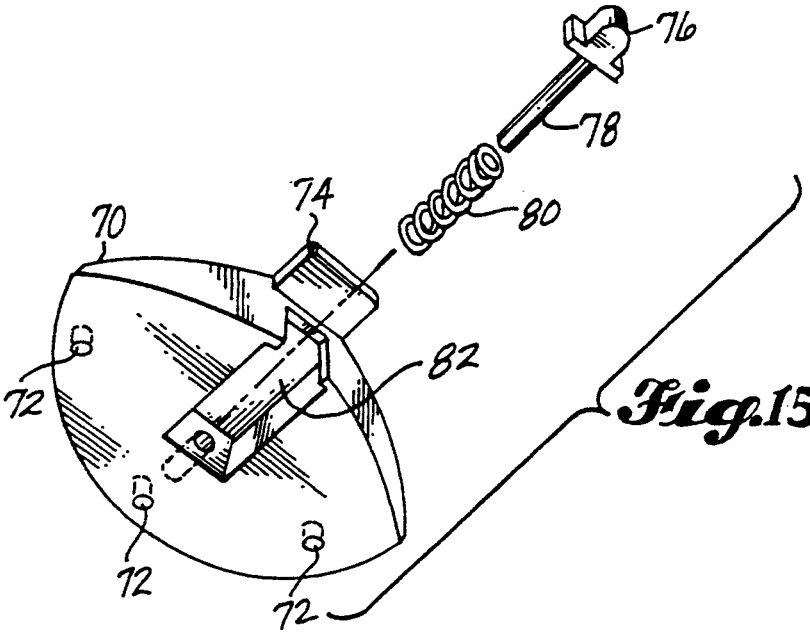
FIG. 15 is a bottom perspective of a boot front hold-down showing parts in exploded relationship.
Figure 16:
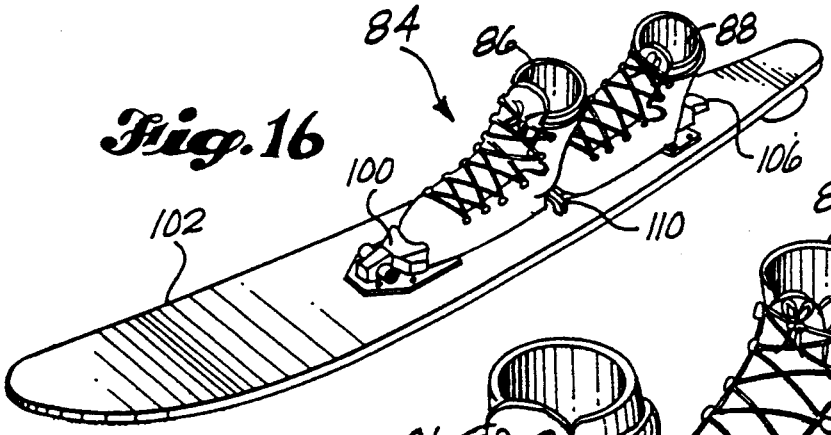
FIG. 16 is a top perspective of a second embodiment of the invention.
Figure 17:
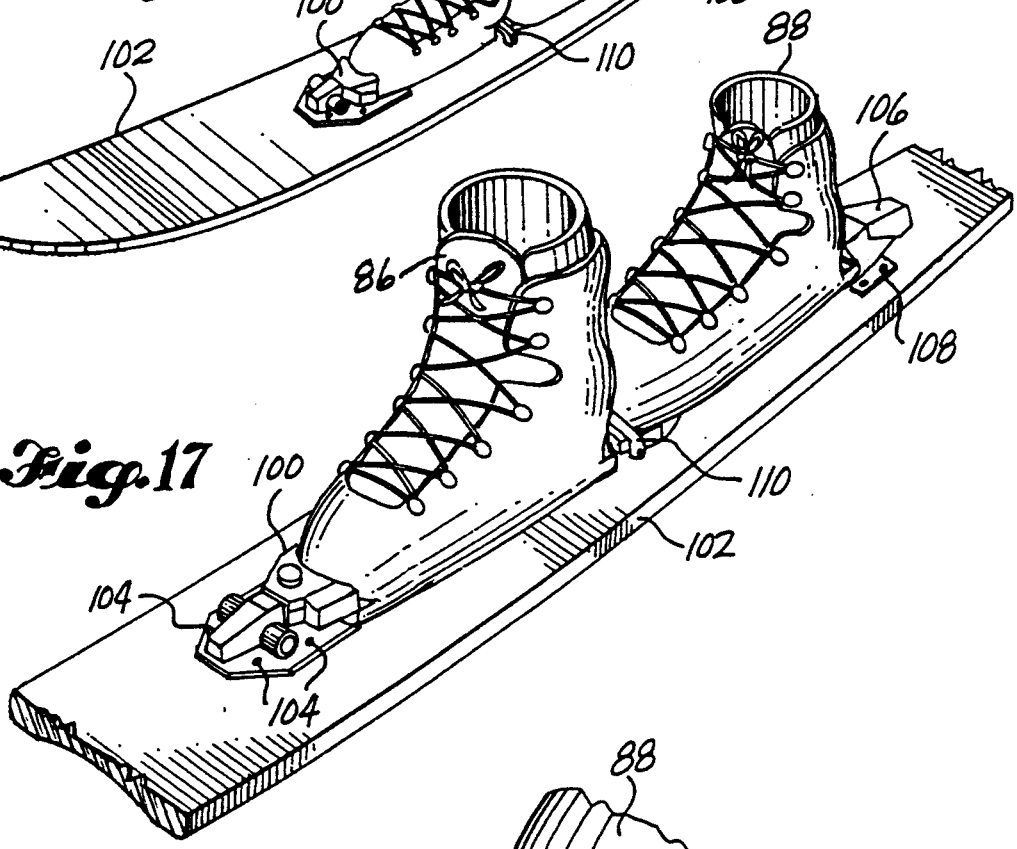
FIG. 17 is an enlarged top perspective of a portion of the invention shown in FIG. 16.
Figure 18:
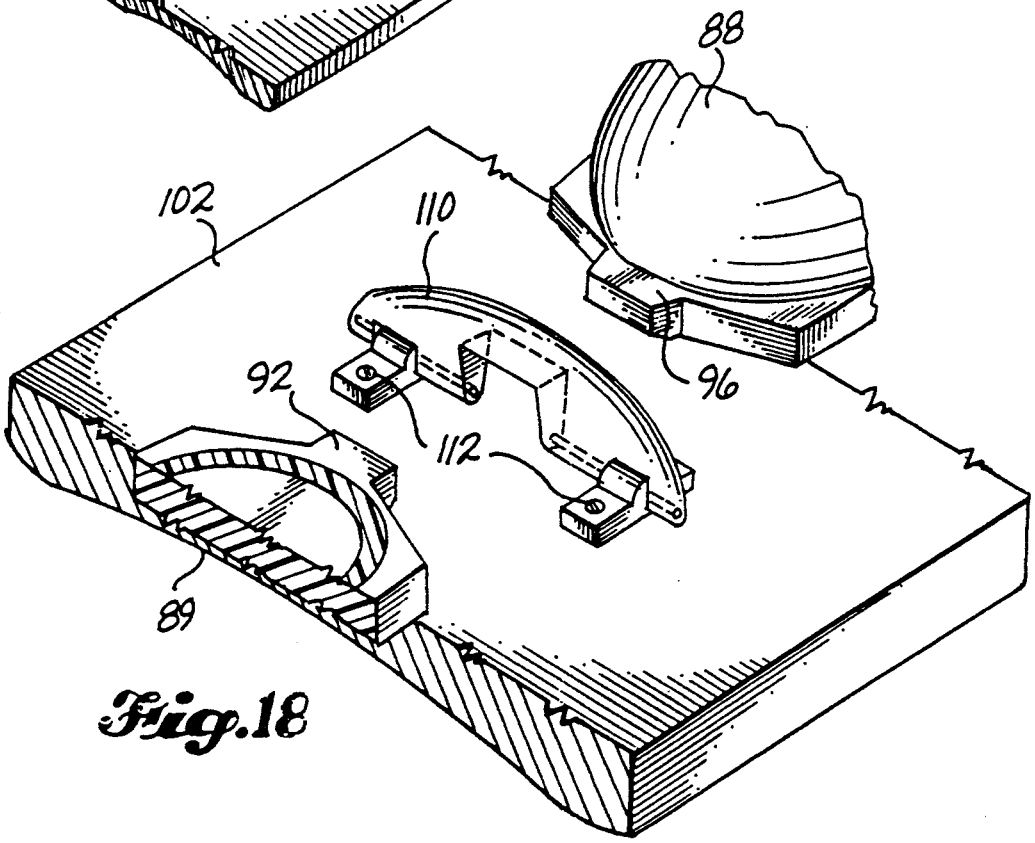
FIG. 18 is a further enlarged fragmentary top perspective view showing details of the connection between boots with parts in exploded relationship.
Figure 19:
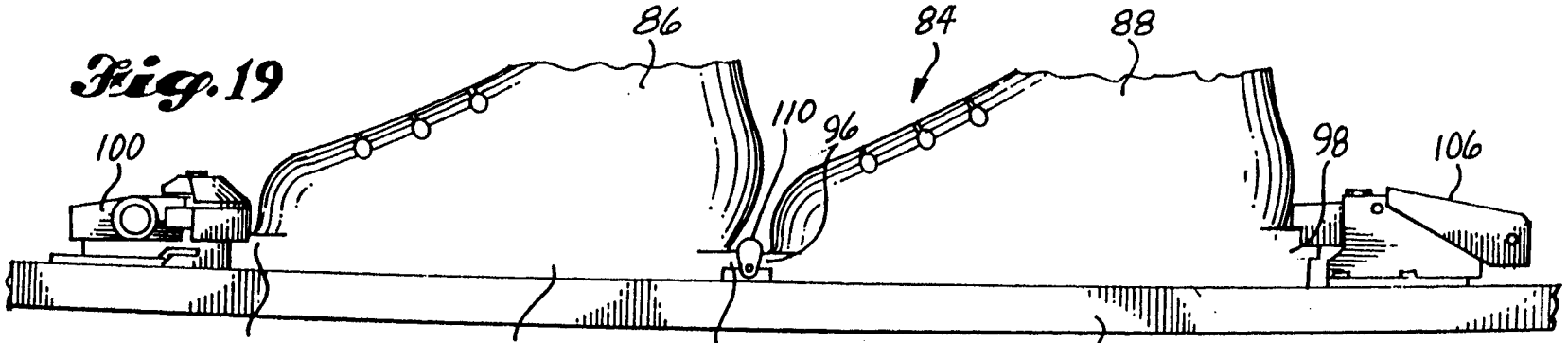
FIG. 19 is a side elevation of the embodiment of the invention shown in FIG. 17 with parts broken away.

The forward end of boot 12 may be secured to the ski as shown in FIGS. 13, 14 and 15 by a recessed forward end projection 66 engaging a holding member 70 secured to the ski by fasteners extending through holes 72. Such holding member has a rearward projection 74 shaped to fit into the recess of the boot toe projection to hold the toe of the boot in place. Projection 74 overlies a plunger having a head 76 mounted on a rod 78 which extends through a compression spring 80. The plunger and spring are housed in a recess 82 in the holding member 70 and the rod head 76 is located to press against the boot forward end projection 66 beneath the recess into which projection 74 fits for pressing the boot rearward to maintain the heel projection 68 in position for latching engagement by the hook of keeper 40 as the ski flexes beneath the boot during use.

As shown in FIG. 7, the sides of the latch hook of keeper 40 are beveled and a notch in boot heel projection 68 is complementally flared to hold the boot heel in place when the keeper is held in its forwardly swung position. Wedging engagement of the beveled surfaces enables a sideways thrust of the boot heel to release the latch if such thrust is great enough.

In order to prepare the ski for skiing, the toe of the boot 12 with the front foot in it is secured to the ski by the holding member 70 projection 72 being inserted into the recess in the boot toe projection 66. Next the treadle 26 is manually pressed down against the base to latch the heel of the front foot boot and projection 60 of the return bent wire 54 is manually pressed sidewise to move latch leg 58 of the wire into notch 52 of the boss 50 where it remains when the treadle is released because the friction created by the resilient upward pressure of thrust arm 30 effected by the torsion spring 34 holds wire leg 58 in the notch 52. Such engagement of the wire leg in the boss notch latches the treadle 26 in its down position with the thrust arm 30 holding slide bar 44 against keeper 40 to maintain it in its forwardly swung position latching the boot rearward projection 68 to the ski.

The most convenient method of using the ski is to secure the front foot boot 12 to the ski as described above, start skiing, and then to insert the rear foot under the instep strap 22. Upon movement of the treadle 26 from its latched position slightly farther downward by pressure of the rear foot on it the treadle boss 50 wedges wire leg 58 sidewise out of the notch 52 so that the treadle 26 is set to be moved upward by pressure of thrust arm 30 whenever the rear foot is removed from beneath the instep strap.

Should the rear foot be separated from the ski, such as from a fall of the skier, the spring 34 swings thrust arm 30 and treadle 26 apart, raising the treadle, which retracts the thrust arm 30 rearward away from the boot 12, thus relieving the pressure of slide bar 44 on the latch keeper 40 and enabling it to be swung away from the boot by upward pressure on its hook of heel projection 68 for releasing the heel of forward boot 12. Such release enables the boot heel to be lifted so that the toe projection 66 can move away from the holding member 70, thus completely freeing the forward boot from the ski.

In a second embodiment of the invention, shown in FIGS. 16 to 25, a ski binding 84 includes a forward boot 86 and a rearward boot 88. The forward boot has a forwardly extending toe projection 90 and a rearwardly extending heel projection 92. The rearward boot has a forwardly extending toe projection 96 and a rearwardly extending heel projection 98. A releasable hold-down keeper unit 100 engageable with the forward boot toe projection 90 is secured to the ski 102 by fasteners 104. This unit is shaped and located to receive the toe projection 90 for holding the toe of the forward boot to the ski. Behind the rearward boot heel is another releasable hold-down keeper unit 106 of conventional type secured to the ski by fasteners 108 in a position to receive heel projection 98 to hold the heel of the rearward boot to the ski.

Figure 20:
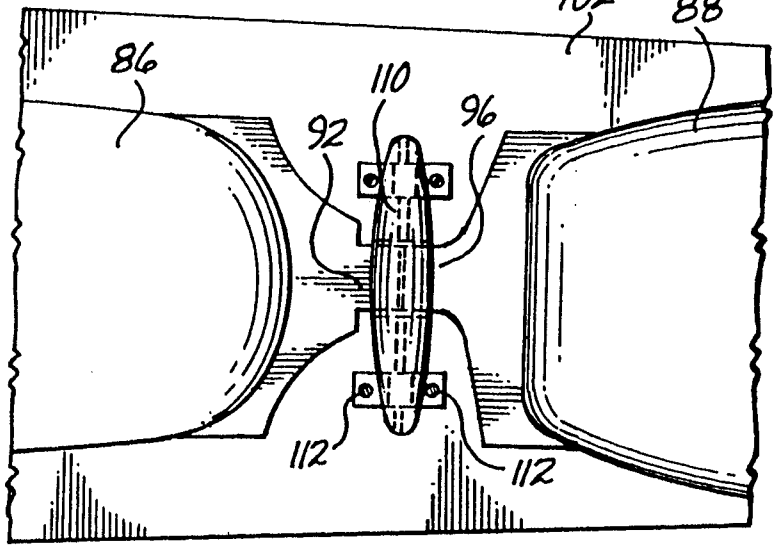
FIGS. 20 and 21 are detailed enlarged plans showing the keeper arrangement of FIG. 18 for forward and rearward boots, FIG. 20 showing the keeper in boot-retaining condition, and FIG. 21 showing the keeper in boot-released condition.
Figure 21:
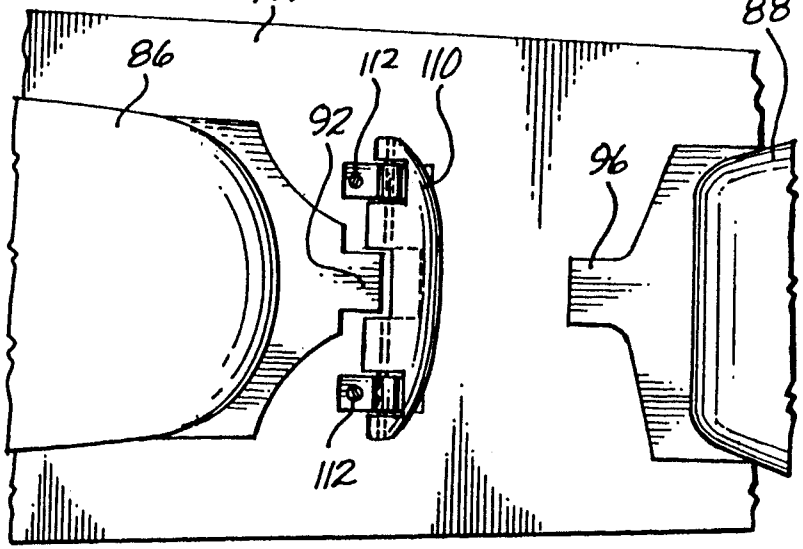
Figure 22:
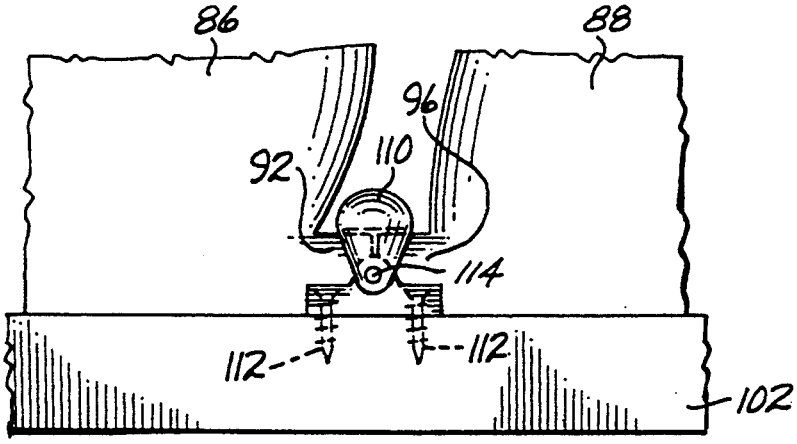
FIG. 22 is a side elevation of the keeper as shown in FIG. 20 on an enlarged scale.

Between the heel of the forward boot 86 and the toe of the rearward boot 88 is a coupling loop or bail keeper 110, pivotally mounted by pin 114 and secured to the ski with rivet, screw or bolt fasteners 112 so as to be held against movement relative to the ski. This coupling loop or bail can embrace both the heel projection 92 of the forward boot and the toe projection 96 of the rearward boot simultaneously as best shown in FIGS. 20 and 22, which projections constitute blocking means restraining appreciable swinging of the keeper bail 110 about its pivot 114 either forward or backward.

Figure 23:
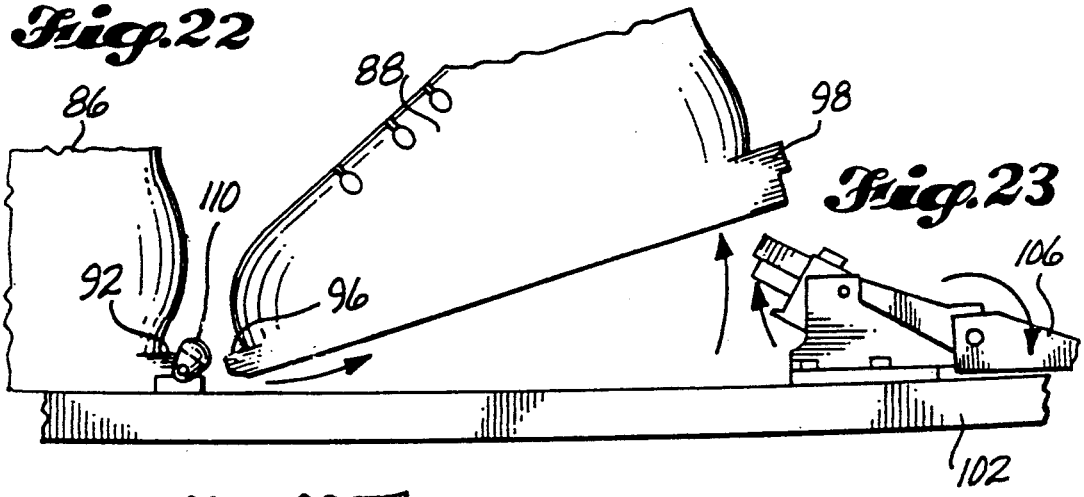
FIG. 23 is a side elevation of the keeper similar to FIG. 19 but showing the rearward boot in releasing position similar to FIG. 21.
Figure 24:
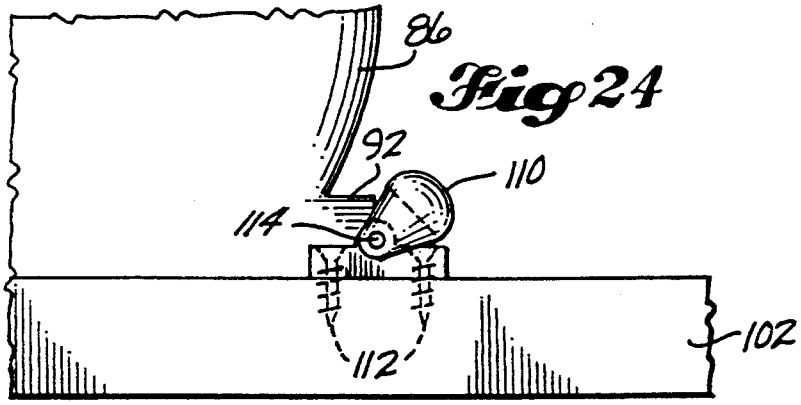
FIG. 24 is an enlarged side elevation of a portion of FIG. 23.
Figure 25:
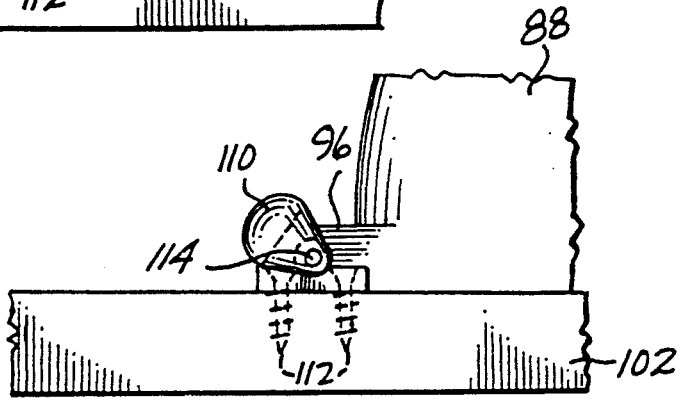
FIG. 25 is an enlarged side elevation similar to FIG. 24, but with the forward boot omitted and the rearward boot in the process of being released.
Figure 33:
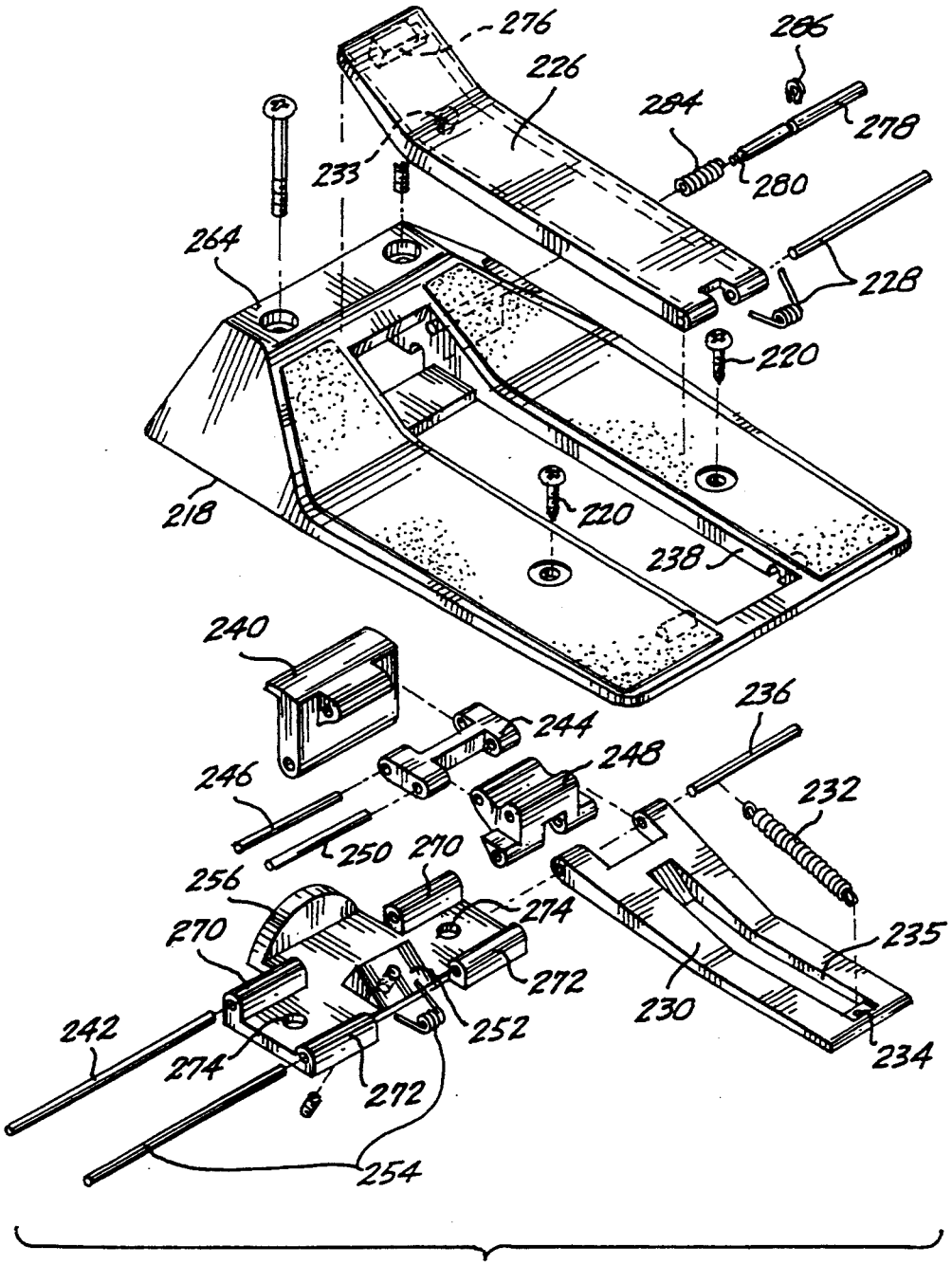
FIG. 33 is a top perspective of one component of the third embodiment of the invention shown in FIGS. 29, 30 and 31 with parts in exploded relationship.

Should the rearward boot 88 be released by excessive force being exerted on the releasable keeper unit 106 holding the boot heel, as shown in FIG. 23, the rearward boot will move rearwardly away from the forward boot, withdrawing the blocking means projection 96 carried by the rearward boot from beneath the loop or bail 110 and enabling the loop or bail keeper to swing rearward about its pivot 114, as best shown in FIG. 24. Such rearward swinging will disengage the bail 110 from the heel projection 92 of the forward boot, enabling the heel of the forward boot to be lifted and the toe projection 90 to be pulled rearward from the hold-down keeper 100 to release the forward boot from the ski.

To prepare the ski for use, the forward boot 86 with the front foot in it is placed with its toe projection 90 inserted into forward hold-down keeper 100 and the bail keeper 110 is swung forward to cover heel projection 92. Next, toe projection 96 of the rearward boot 88 is inserted under the loop or bail keeper 110 to block rearward swinging of the bail keeper. The rearward boot rear hold-down latch 106 is swung to engage and hold the heel projection 98 of the rearward boot 88. Both boots 86 and 88 will then be held to the ski.

When during skiing the skier exerts excessive force on the forward boot 86 the toe hold-down 100 of that boot will release. If excessive force is exerted on the rearward boot 88, the hold-down keeper 106 for the rearward boot heel will be released. The released boot will pull away from the ski to withdraw the corresponding blocking projection 92 or 96 from under the coupling loop or bail keeper 110. Such keeper will then immediately swing away from the projection of the boot remaining under it to release that projection also so as to release such other boot from the ski.

The function of the third embodiment of the invention shown in FIGS. 26 through 37 is similar to that of the first two embodiments described above. The structure of such third embodiment is more similar to that of the first embodiment shown in FIGS. 1 through 15 than it is to the second embodiment of the invention shown in FIGS. 16 through 25 in that, while the holder for the front foot is a boot 12, the holder 16 for the rear foot is primarily an instep strap 22.

The holder 16 for the rear foot includes a base 218 held to the ski 14 by screws, rivets or other fasteners 220. Beneath the instep strap 22 is a treadle 226 pivoted to the base 218 by a torsion spring hinge 228 urging the treadle to swing upward. A thrust arm 230 beneath the treadle has its rearward end operably connected to the central portion of the treadle by the rearward end of the thrust arm sliding in ways in the underside of the treadle and urged away from the treadle hinge 228 by a helical tension spring 232 connected between a lug 233 projecting downward from the underside of the treadle 226 and an aperture 234 in the rearward end of the thrust arm and pulling such sliding end of the thrust arm toward the swinging end of the treadle. Such spring is received in slot 235 in such thrust arm shown in FIG. 33.

The forward end of the thrust arm 230 is connected by a pivot 236 to keeper or latch-actuating mechanism. The thrust arm 230 will fold beneath the treadle 226 as the treadle is swung downward so that the folded treadle and thrust arm are received in a slot 238 in the base 218, as shown in FIG. 30.

The keeper or latch interengageable between the rearward portion of the front foot holder 12 and the forward portion of the rear foot holder includes a latch hook keeper 240, the lower end of which is mounted on the ski by a pivot 242. Such keeper is swung about its pivot by a toggle joint including a link 244 connected to the keeper by a pivot 246. The other link of the toggle joint is a bell crank 248 to which the forward end of the thrust arm 230 is connected by pivot 236. The two links 244 and 248 of the toggle joint are connected together by pivot 250. The toggle joint is mounted on a keeper base 252 by the latch hook pivot 242 and a torsion spring hinge 254 mounting the lower end of the bell crank 248 and urging such bell crank to swing rearward.

A lug 256 is mounted on and projects upward from the forward end of the keeper base 252 for engagement in a downwardly opening socket 258 in the heel portion of the mounting 260 for the front boot 12. A ledge projection 262 projects rearward from the mounting, as shown in FIGS. 29 and 31, for latching engagement by the hook of keeper 240 when the toggle joint 244, 248 is extended from the condition shown in FIG. 29 to that shown in FIG. 30.

Downward movement of treadle 226 will force thrust arm 230 to the left from the position shown in FIG. 29 to the position shown in FIG. 30. Such lengthwise movement of the thrust arm will swing bell crank 248 counterclockwise from the position of FIG. 29 to that of FIG. 30, overcoming the force of torsion hinge 254 tending to swing bell crank 248 rearward, which will extend the toggle joint causing link 244 to swing keeper 240 counterclockwise until its hook engages the ledge 262 of projection 260 in latched condition, as shown in FIG. 30. The keeper will be maintained in such latched position as long as the rear foot remains beneath the instep strap 22 for holding treadle 226 in its down position.

The forward end portion of the treadle 226 is bent upward so that when the treadle is swung downward by the rear foot pressing on it as it is inserted under the instep strap 22 to the position shown in FIG. 30, the upwardly inclined forward portion of the treadle will be faired into the rearward portion of the housing 264 overlying and shielding the keeper-actuating linkage. As shown in FIG. 34, the underside of the housing 264 has in it a central recess 266 for receiving the keeper 240 and its actuating toggle joint, as shown in FIGS. 29 and 30. Shallower recesses 268 at opposite sides of the central recess 266 receive the front and rear bosses 270 and 272 of the keeper base 252, as indicated in FIG. 34. The keeper base 252 can be anchored in place by bolts extending downward through the housing 264 and through apertures 274 shown in FIG. 34 between the bosses 270 and 272.

A latch is provided to hold the treadle 226 down substantially in the position shown in FIG. 30 prior to insertion of the rear foot beneath the instep strap 22. Such latch mechanism is shown best in FIGS. 29, 30, 35 and 36 as including a boss 276 projecting downward from the forward portion of the underside of treadle 226. When the treadle is in its down position shown in FIG. 30, a latch pin 278 slidable transversely through a bore in base 218 is aligned with such boss. The tip 280 of such latch pin adjacent to boss 276 can fit into a socket 282 in the side of the boss when the latch pin is slid from the unlatched position shown in FIG. 36 to the latched position shown in FIG. 35. A helical compression spring 284 encircling the latch pin and reacting between an abutment 286 on the latch pin, such as a washer welded to the pin or a pin extending through a transverse aperture in the latch pin, and the wall 288 of a cavity in the housing through which the latch pin extends normally urges the latch pin into the unlatched position of FIG. 36. The latching tip 280 of the latch pin can be engaged in the boss socket 282 by manual pressure on the outer end of the latch pin sufficient to overcome the force of spring 284 and slide the latch pin from the position shown in 36 to that of FIG. 35.

In using the ski, the treadle 226 is depressed manually from the broken line position shown in FIG. 36 to the solid line position in opposition to the force of torsion spring hinge 228 tending to swing the treadle upward. The latch pin 278 is then pressed manually to the right, as seen in FIG. 36, until the latching tip 80 engages in treadle boss socket 82, as shown in FIG. 35. If the manual pressure on the treadle is released followed by release of the latch pin, the friction between the latch pin tip 280 and the socket 282 will maintain the latch pin 278 in the position slid to the right, as shown in FIG. 35, and hold the treadle 226 in its down position.

The skier can place his front foot in the boot 12 and secure the boot to the ski by such manual depression of the treadle before inserting his rear foot under the instep strap 22. By such insertion of the rear foot 24 under the instep strap, as indicated in FIG. 30, pressure will be exerted on the treadle 226 to swing it downward slightly farther so that the treadle boss socket 282 no longer presses upwardly against the tip 280 of the latch pin. Spring 284 will then function to retract latch pin 278 from the position shown in FIG. 35 to the position shown in FIG. 36, but the unlatched treadle will still be held in the lower position of FIG. 30 by the pressure on it of the rear foot inserted under the instep strap 22.

If the skier should withdraw his rear foot 24 from beneath the instep strap 22, the unheld and unlatched treadle 226 will be swung upward by its spring hinge 228 from the position shown in FIG. 30 to the position shown in FIG. 29 to relieve the thrust force of thrust arm 30 toward the left, as seen in FIGS. 29 and 30, on bell crank 248. The torsion spring hinge 254 of the bell crank will then swing it in a clockwise direction to contract the toggle joint 244, 248 and swing keeper 240 in a clockwise direction to withdraw its hook from engagement with ledge 262 of the forward boot heel projection 260. Such projection will thus be unlatched so that the front boot is free to be withdrawn from the ski.

Figure 37:
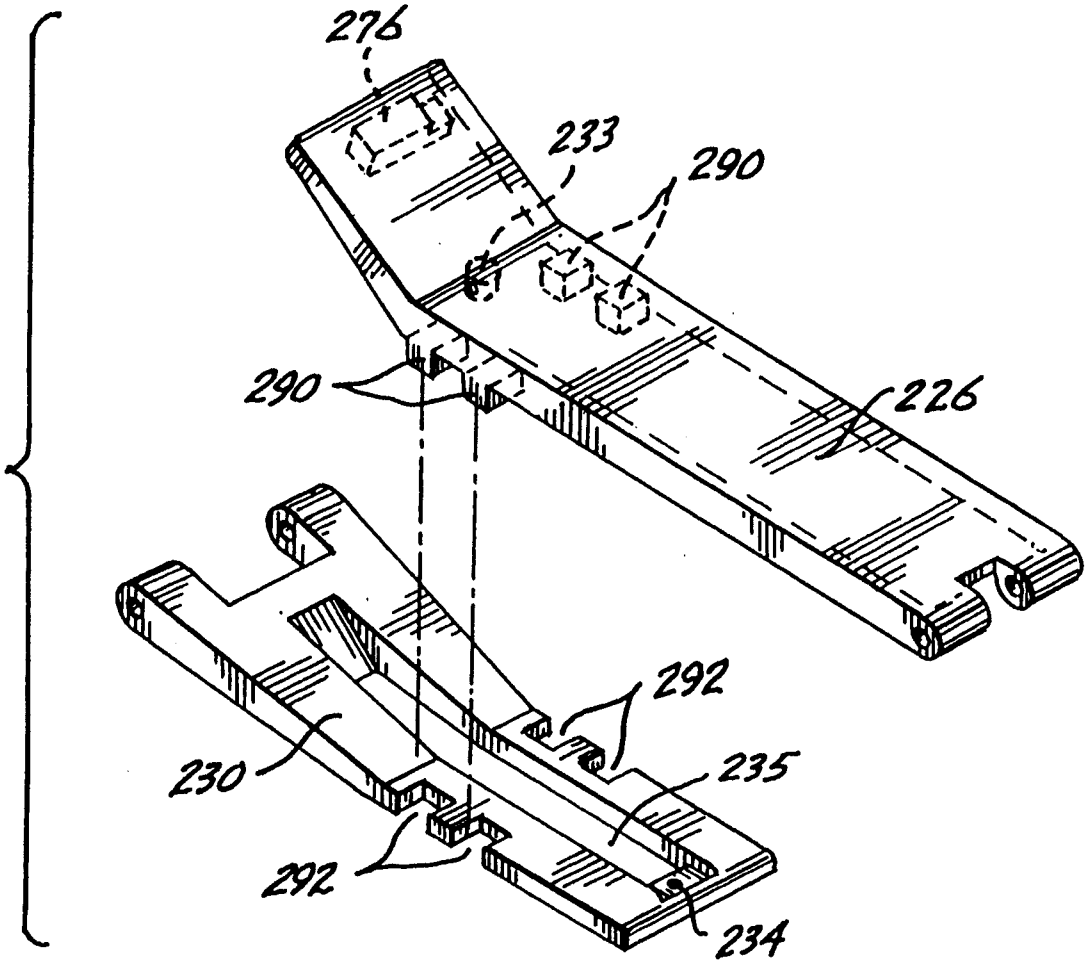
FIG. 37 is a top perspective of a portion of the third embodiment of the invention shown in FIGS. 29 and 30 showing a variation with parts in exploded relationship.

FIG. 37 shows a modification of the treadle 226 and the thrust arm 230. The modified construction of the treadle and thrust arm is provided to insure that the skier knows when the heel of the front boot is latched to the ski. The treadle and thrust arm must be in a predetermined relationship to enable the treadle to be swung from its upper position shown in FIG. 29 to its down position shown in FIG. 30 for engagement of the hook of keeper 240 with the ledge 262 of the front boot heel projection. Such modified structure includes lugs 290 projecting downward from opposite edge portions of the treadle 226 in position for engagement in socket notches 292 in the opposite edge portions of the thrust arm 230. If the lugs 290 on the treadle 226 do not fit into the socket notches 292 of the thrust arm the treadle and thrust arm cannot be folded together, alerting the skier to the fact that the keeper 240 is not latching the heel projection of the front boot.

FIGS. 38 to 46, inclusive, show a fourth embodiment of the invention which is of a type generally similar to the first and third embodiments of the invention in that such binding includes a forward boot 12 for a front foot and a rearward foot-engaging member 16 on the same ski for holding the rear foot which includes an instep strap 22 beneath which the rear foot 24 can be inserted.

Figure 1:
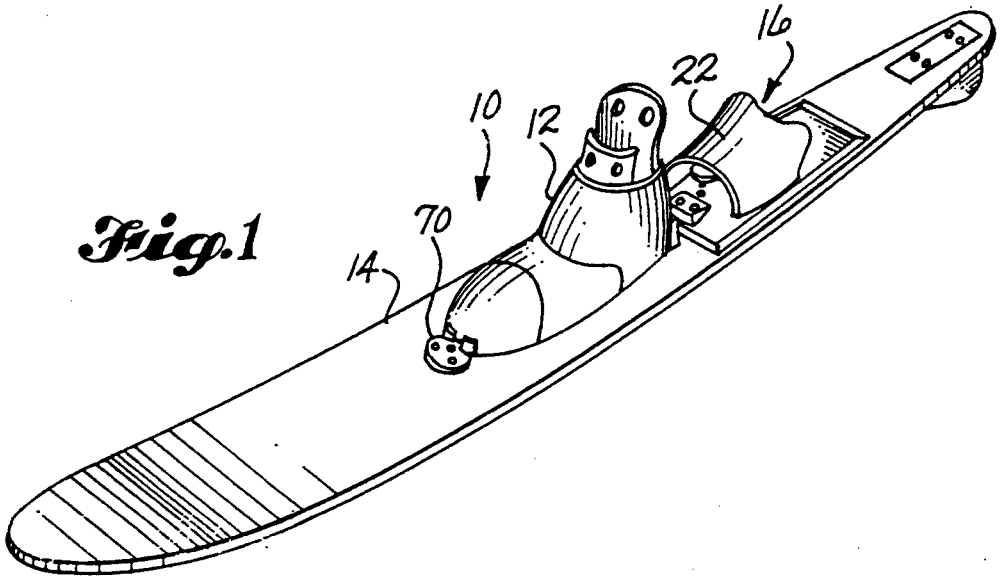
FIG. 1 is a perspective view of one embodiment of the invention.
Figure 2:
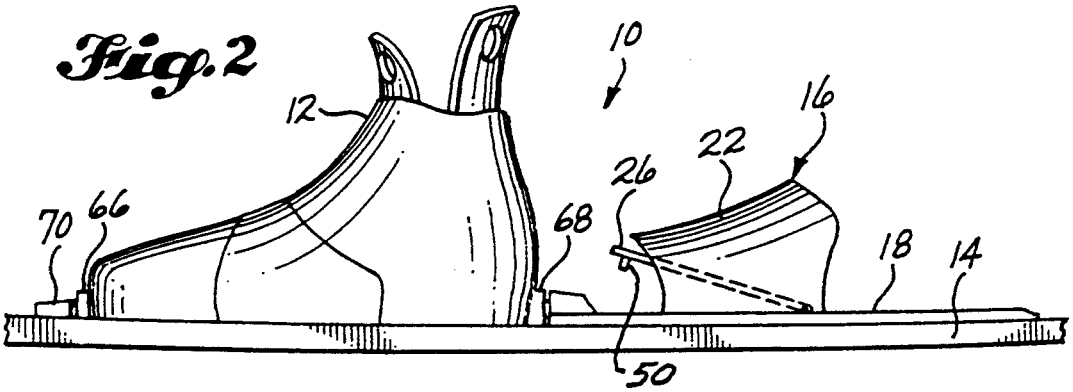
FIG. 2 is a side elevation.
Figure 3:
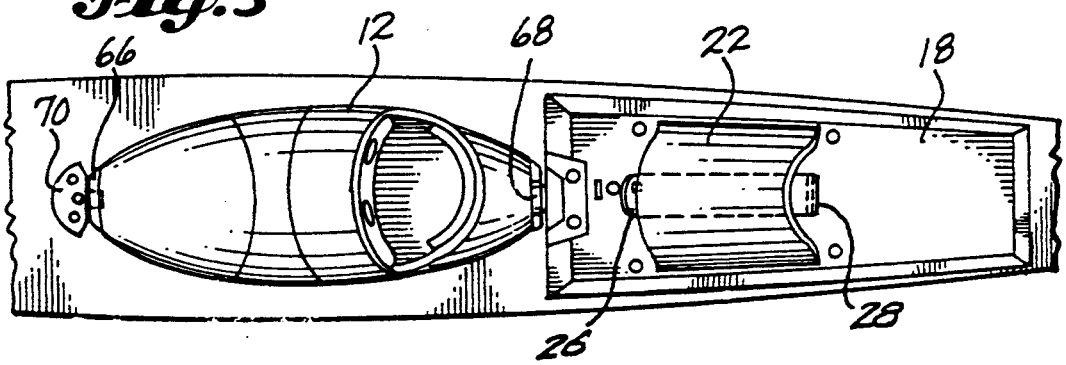
FIG. 3 is a plan of the embodiment of FIG. 1.
Figure 4:
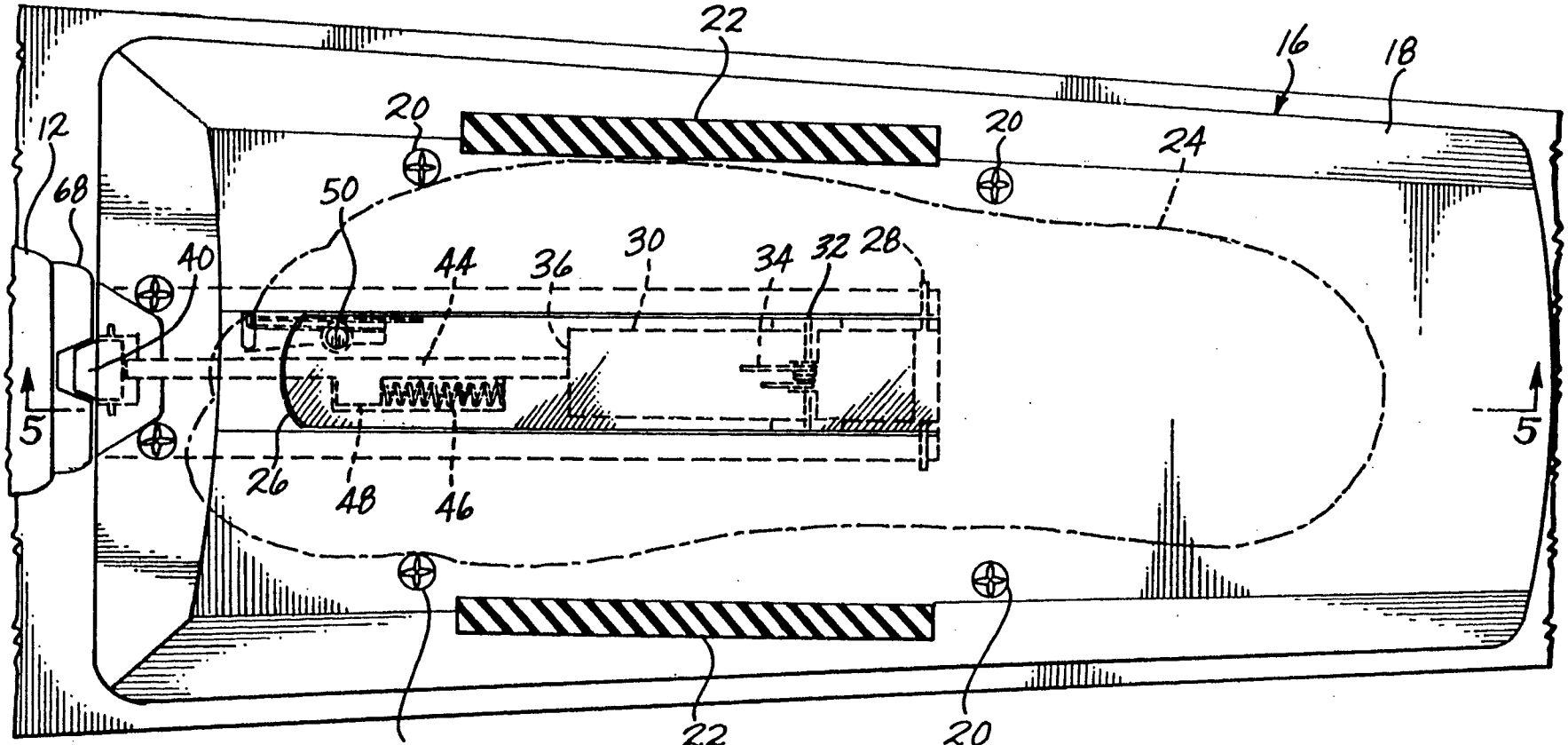
FIG. 4 is an enlarged plan of part of FIG. 3 with parts broken away.

The rearward foot-engaging member has a base 318 secured to the ski 14 by suitable securing members similar to the securing fasteners or bolts 20 shown in FIG. 4 as securing the base 18 to the ski 14.

Figure 38:
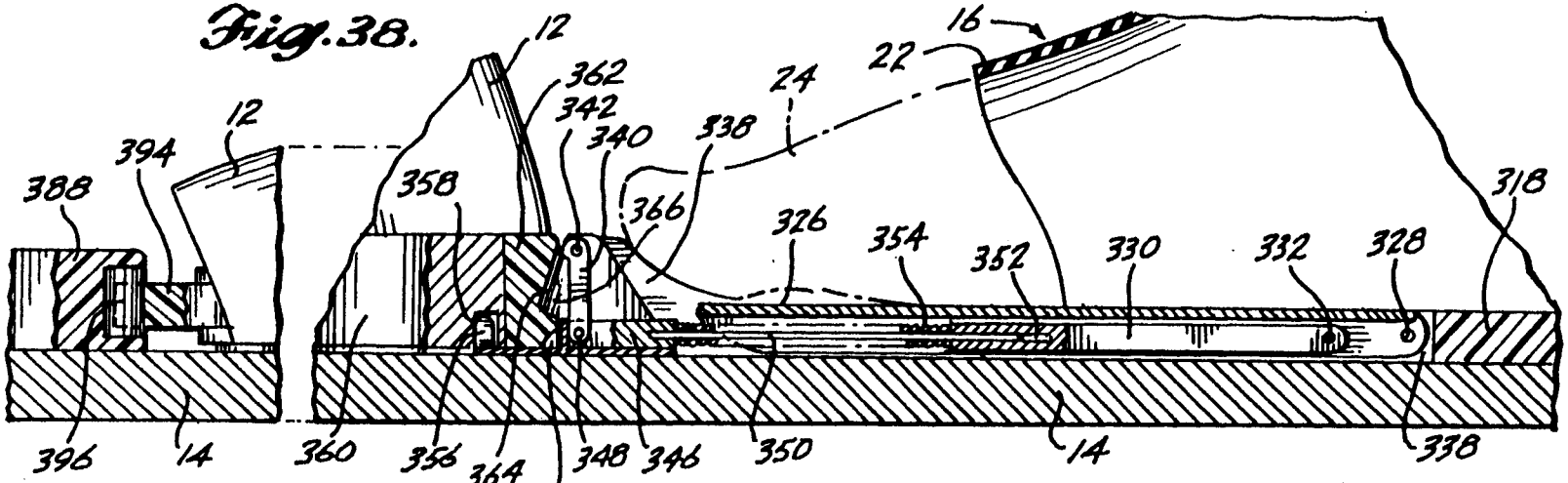
FIG. 38 is a central vertical longitudinal section through a ski showing a fourth embodiment of the invention generally similar to the first and third embodiments of the invention.
Figure 39:
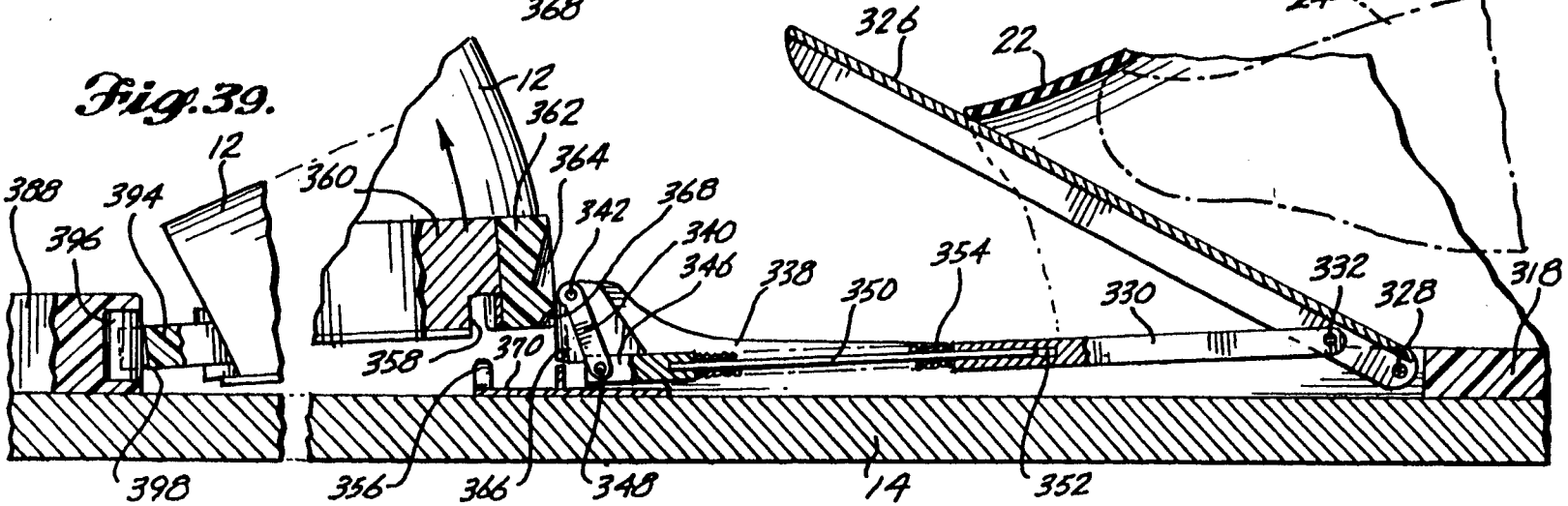
FIG. 39 is a similar view showing parts in different positions.
Figure 44:
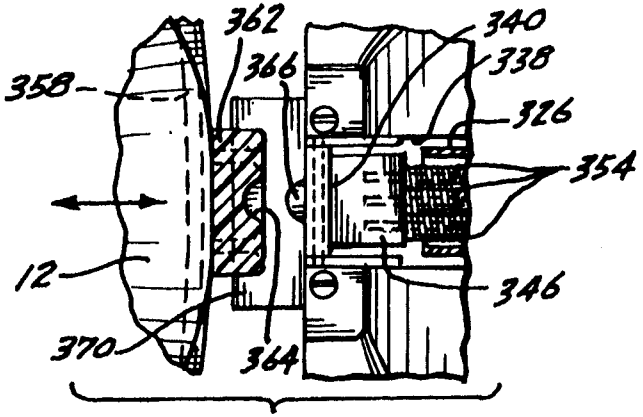
FIG. 44 is a fragmentary top plan of another portion of the ski binding shown in FIGS. 38 and 39 with parts broken away and with interengageable components shown in separated relationship.

The rearward foot-engaging means includes a treadle 326 having its rearward end secured by a pivot 328 to the base 318 so that its forward end can swing from the lower position shown in FIG. 38 to the upper position shown in FIG. 39 about such pivot. Such treadle is of channel shape having downturned edge flanges. A thrust arm 330 extending longitudinally of the ski is received in the downwardly-opening channel of the treadle and has its rearward end pivotally connected to the treadle by a pivot 332 spaced a short distance forward of the treadle pivot 328, as shown in FIGS. 38 and 39.

In their nested relationship shown in FIG. 38, the treadle 326 and thrust arm 330 are received in an upwardly-opening recess 338 in the base 318. Forward of the forward end of the treadle when it is in its lower position shown in FIG. 38 is an upright link 340, the upper end of which is secured in the recess 338 by a pivot 342. The lower end of such link is connected by a pivot 348 to a slidable bar or block 346 received in the recess 338. Such block is operatively connected to thrust arm 330 and held in alignment with it by a plurality of rods 350, the forward ends of which are secured in bores in plug 346 and the rearward ends of which are slidably received in bores 352 in the forward end of thrust arm 330. Helical compression springs 354 encircle such rods 350. The forward ends of such springs bear against the rearward end of block 346 and the rearward ends of such springs bear against the forward end of thrust arm 330 so that such springs reacting from the thrust arm urge block 346 forward which, being connected by pivot 348 to link 340, presses the lower end of such link forward.

Figure 45:
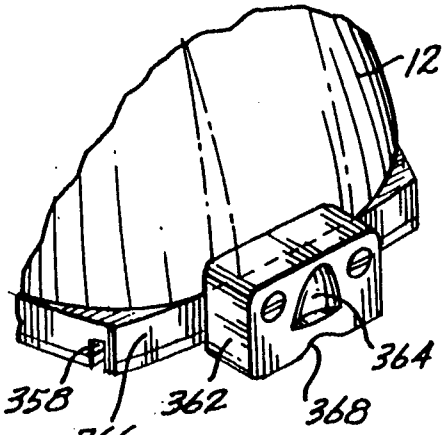
FIG. 45 is a rear top perspective of one of the components shown in FIG. 44.

A lug 356 is fixed on and upstands from the base 318 for engagement in a downwardly opening socket 358 in the form of a deep arcuate groove in the heel portion of the mounting 360 for the front boot 12 as shown in FIG. 39 curved about a center in the toe portion of such boot. A projection 362 projects rearwardly from the heel portion of the mounting 360 as shown in FIGS. 38, 39 and 45 and has in it a rearwardly opening socket recess 364 for engagement by latch projection 366 projecting forwardly from the forward side of the link 340 which is swingable about pivot 342 to displace the latch projection fore and aft of the ski.

When the boot heel 12 is in its lower position of FIG. 38 so that the lug 356 fits into the socket 358 of the heel portion of the mounting 360, the rearwardly opening socket 364 may be in alignment with the latch projection 366 which will be pressed into such socket by the force of springs 354 pressing on the rearward end of bar or block 346. The keeper latch projection 366 will be held firmly in such engagement with its socket 364 as long as treadle 326 is held in the depressed position of FIG. 38 by foot 24 being inserted beneath the instep strap 22 as shown in FIG. 38. In this position the force exerted by springs 354 on block 346 will be sufficient to hold link 340 in its forwardly swung position to maintain forward boot 12 attached to the ski.

If the rear foot should be withdrawn from beneath the instep strap 22, as shown in FIG. 39, the extending force of springs 34 will move pivot 332 on treadle 326 rearward to swing such treadle upward, while at the same time relieving to some extent the forward thrust on latch projection 366 so that an upward or sidewise wrench on boot 12 will free the heel socket 364 from the latch projection for releasing the keeper. To depress the latch projection by movement of socket 364, the boot heel can be swung upward, as indicated by the arrow in FIG. 39, or sidewise in which case socket groove 358 will swing with respect to lug 356.

Figure 46:
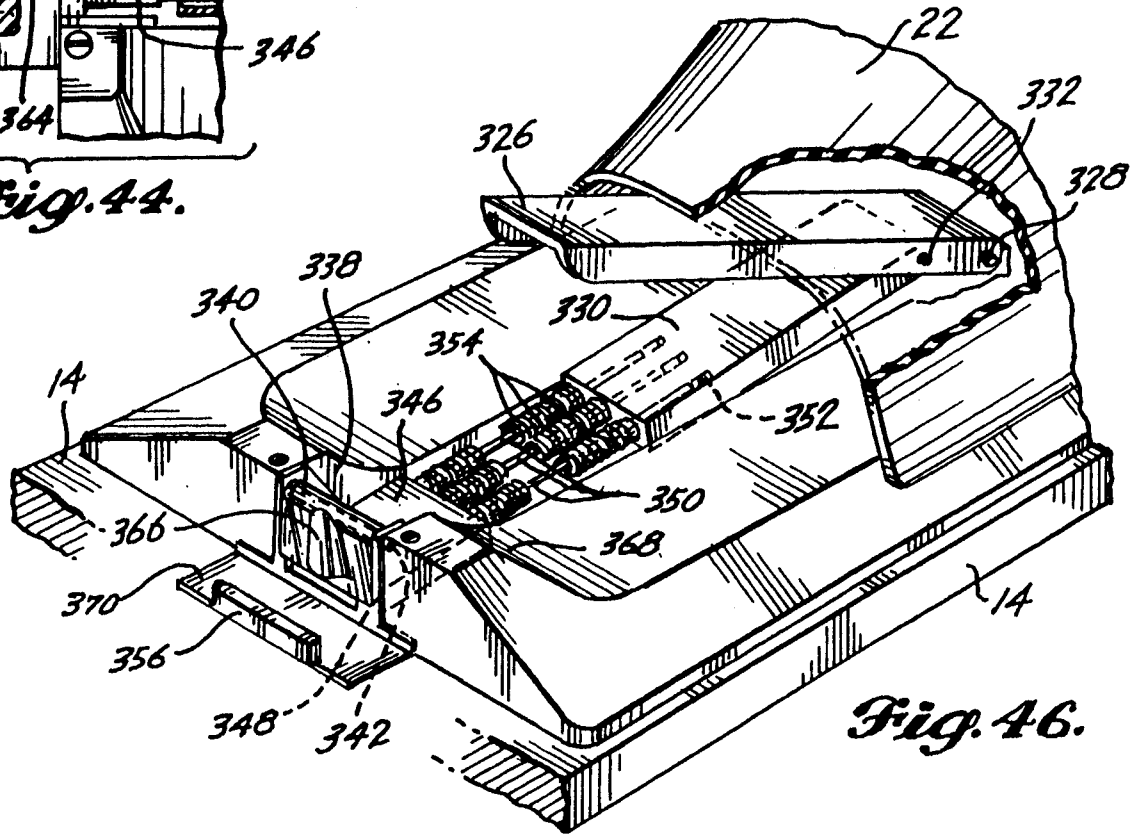
FIG. 46 is a front top perspective of the other component shown in FIG. 44 with parts broken away.
Figure 47:
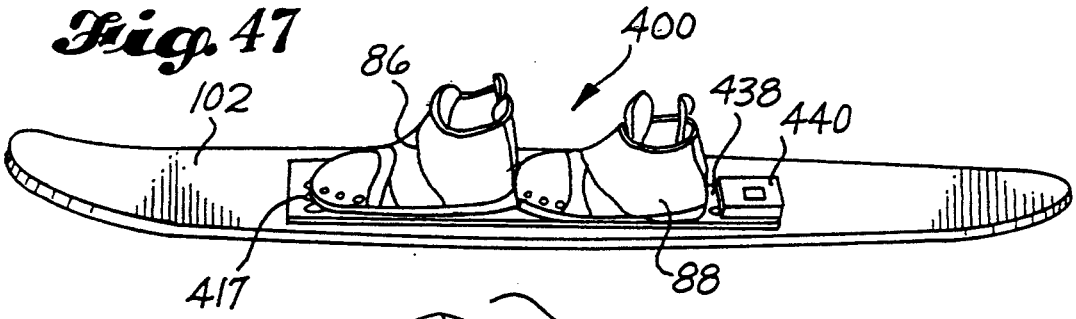
FIG. 47 is a lateral top perspective of a ski equipped with a fifth embodiment of the invention which is generally similar to the second embodiment of the invention.

The latch projection 366 tapers upwardly so that when link 340 is in its forwardly swung position shown in FIG. 38, the forward face of the keeper latch projection 366 will be inclined forwardly and downwardly. It is preferred that the lower corner of the heel projection 362 have in it a recess 368 of a shape to match the forward surface of the latch projection 366, which preferably is rounded as shown in FIG. 46. If the heel of the front foot wearing the boot 12 is pressed downward toward the ski 14, the recess 368 will engage the front surface of the latch projection 366 when it is in the position shown in FIG. 38. Further downward pressure of the front foot heel will slide the rearwardly projecting ledge 362 downward to wedge the latch projection 366 and, consequently, the link 340, rearward, swinging about pivot 342 to the position shown in FIG. 39. Continued downward movement of the boot heel will bring the latch socket 364 into engagement with the latch projection 366, as shown in FIG. 38, whereupon the thrust of compression springs 354 will push block 346 forward to engage latch projection 366 in its socket 364 for forming keeper member so that the heel of the forward boot 12 will again be retained in its position latched to the ski as long as the rear foot 24 is held under the instep strap 22 to maintain the treadle 326 in its lower position.

As the heel of the forward boot is pressed downward from the position of FIG. 38 to the position of FIG. 39, the arcuate groove socket 358 will be pressed down over the lug 356 to form keeper means preventing appreciable fore and aft movement of the boot 12 but not restraining movement of the boot heel laterally relative to the ski. Such lug can be integrated with the base 318 by being mounted on a plate 370 projecting forwardly from the base, as shown best in FIG. 46.

In order to enable the forward boot 12 to be freed from the ski when its heel latch socket 364 is wrenched free of the latch projection 366 as described above, the mechanism for holding the toe of the forward boot to the ski must be releasable. The toe of boot 12 could be held to the ski in releasable fashion by the mechanism shown in FIGS. 13, 14 and 15. An alternate form of releasable boot toe-holding mechanism is shown in FIGS. 38 to 43. Such toe-holding mechanism includes a block 388 secured to the ski by bolts or rivets 390 and having a rearwardly opening recess 392. The toe of the boot 12 has a forwardly projecting bifurcation 394 of a width, length and thickness to fit reasonably snugly in such block recess. A shank or post 396 is located in such recess about midway between its opposite ends and extending from top to bottom of the recess. The central portion of the boot toe bifurcation 394 forms a forwardly opening notch 398 between its tongues or fingers of a size to receive reasonably snugly the post 396 when the fitting is inserted into the recess with the fingers extending forwardly from the boot toe along opposite sides of the post to limit movement of the bifurcation tongues or fingers transversely of the ski.

While the projections of the boot toe fitting 394 at opposite sides notch 398 could fit snugly in the recess 392 of the block fixed on the ski, it is preferred that the toe fitting notch 398 be interengageable with or shank post 396 provided to enable the fitting to be held more centrally in the recess even though the boot might be swung sideways to some extent relative to the ski.

In order to secure the boot 12 to the ski, it is only necessary to insert the toe fitting 394 into the recess 392 with the notch 398 straddling shank 396 and then to swing the heel of the boot downward so that the latch socket 364 of the heel fitting will engage the latch projection 366 in the manner described above.

Figure 50:
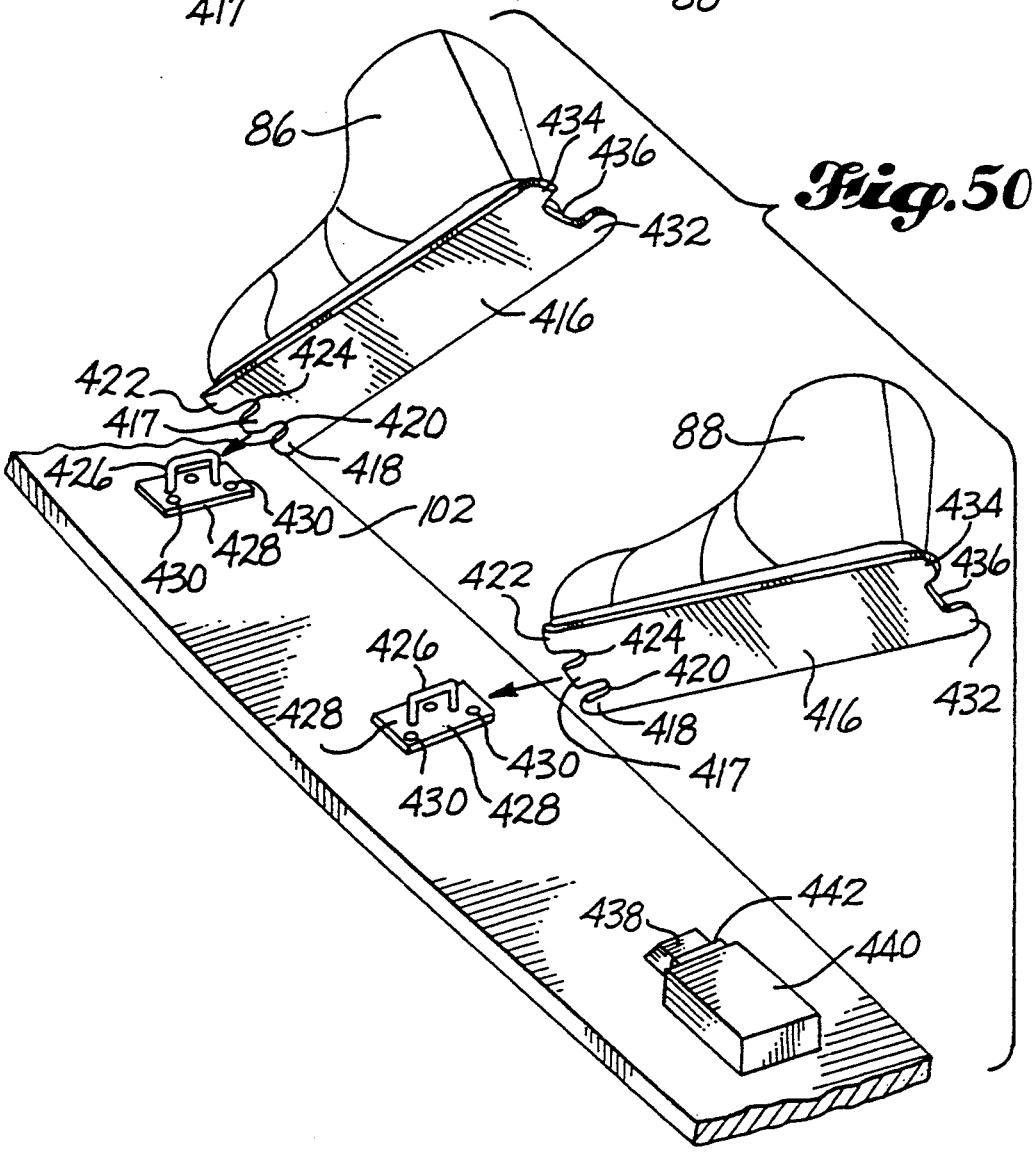
FIG. 50 is a rear top perspective of the ski binding shown in FIG. 47 with parts shown in exploded relationship.
Figure 48:
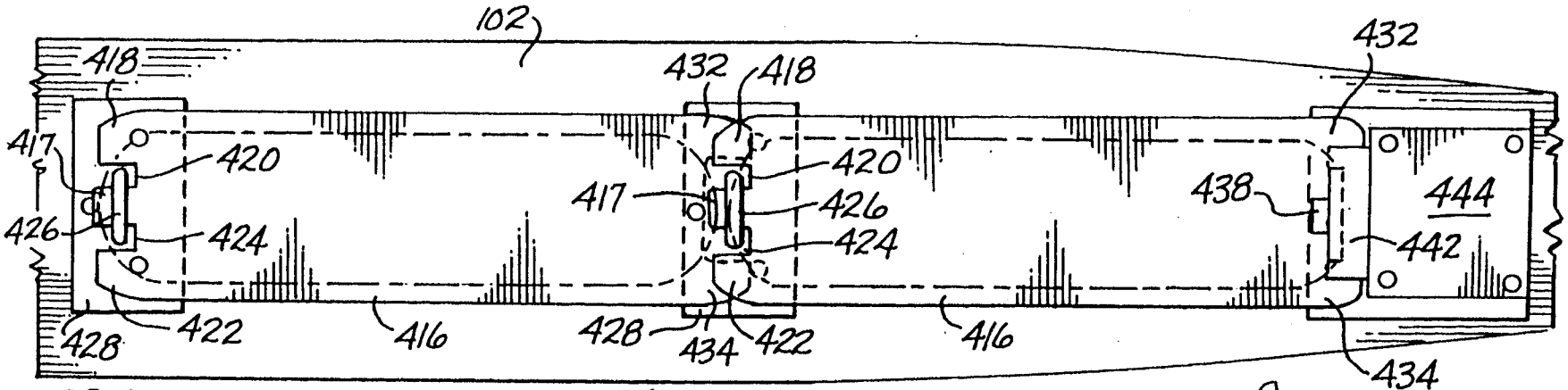
FIG. 48 is a top plan of the embodiment of the ski binding shown in FIG. 47 with parts shown in phantom.
Figure 49:
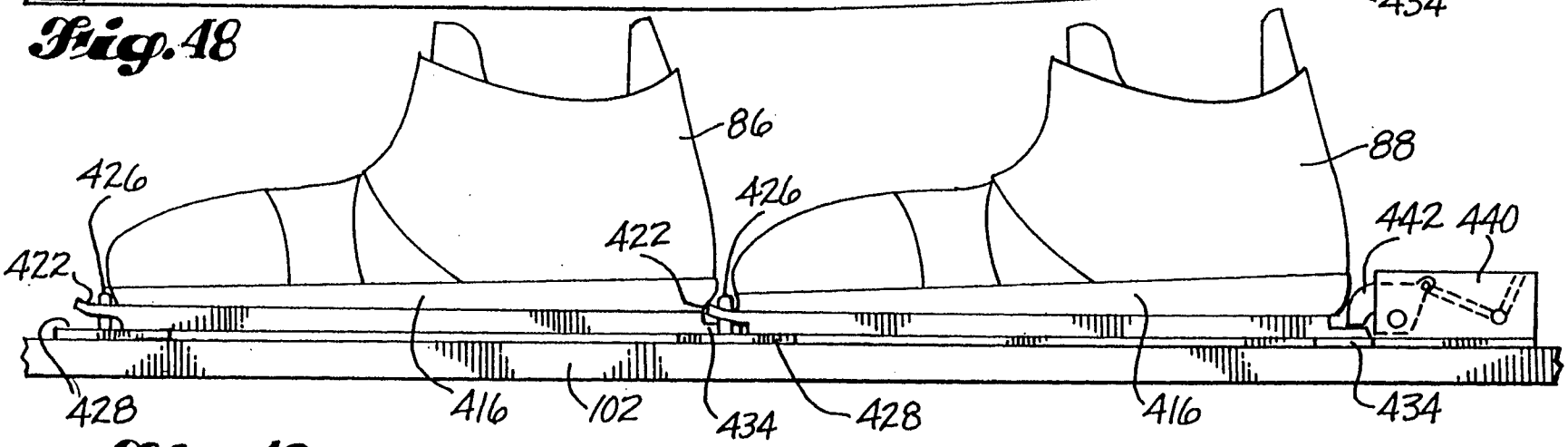
FIG. 49 is a side elevation of such ski binding.
Figure 51:
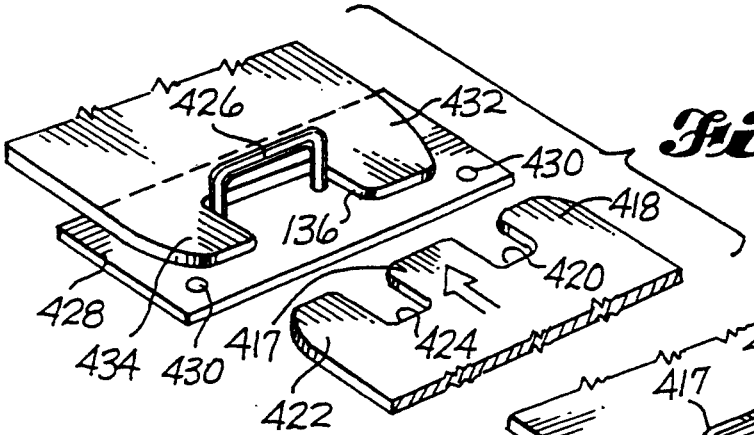
FIG. 51 is a fragmentary top perspective looking forward of a portion of the ski binding shown in FIG. 50 with components shown in separated relationship.

A fifth modification of the ski binding is shown in FIGS. 47 to 54, inclusive, which is generally similar to the second modification shown in FIGS. 16 to 25, inclusive, in that both the front foot and the rear foot are held in a forward boot 86 and a rearward boot 88, respectively, secured to the single ski 102. In this instance, the ski binding 400 includes two baseplates 416 for the respective boots 86 and 88 having forward and rearward furcated ends, which can be identical. As shown in FIGS. 50 and 51, the forward end of the baseplate is trifurcated to provide a center toe projection or finger 417 projecting forward from the central portion of each baseplate flanked by side toe projections or fingers 418 and 422 spaced from the central projection or center finger by deep notches 420 and 424. Such central projection or center finger can be inserted through an arch or a loop 426 carried by a baseplate 428 which is secured to the ski 102 by screws or rivets 430. Each loop or arch includes two posts or shanks spaced transversely of the ski having their upper ends connected by a crosspiece to form a socket engageable by the finger 47 projecting forward from the boot toe. While the side projections or fingers 418 and 422 respectively straddle the loop the deep notches 420 and 424 of the baseplate receive the respective spaced posts or shanks of the loop and the fingers extend along opposite sides of the two posts as shown in FIG. 48 to form a keeper limiting movement of the projections transversely of the ski.

Figure 52:
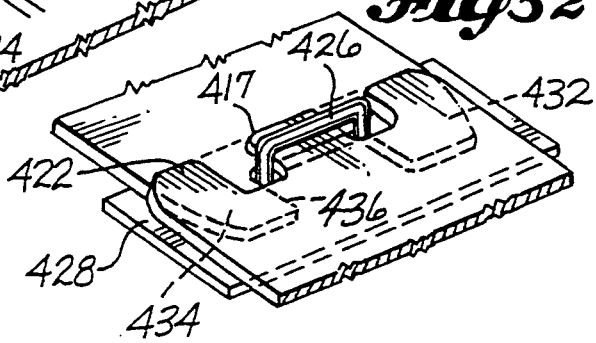
FIG. 52 is a similar view with the components shown in assembled relationship.

As shown best in FIG. 50, two loops or arches 426 are mounted centrally on the ski 102 at locations spaced apart a distance substantially equal to the length of one baseplate 416. The rearward end of each baseplate 416 is bifurcated to form heel projections or tongues 432 and 434 spaced apart laterally a distance generally equal to the width of the loop or arch 426 to form a notch 436 which will straddle the loop as shown in FIGS. 51 and 52.

The baseplate 416 of the forward boot 86 can be placed on the ski by fitting the toe projections 417, 418 and 422 with the forward arch 46, the center tongue 417 being inserted through the arch and the side tongues 418 and 422 straddling the arch. The rearward notch 436 would receive the loop 426 between the two boots 86 and 88. The depth of the deep notches 420 and 424 will limit the forward movement of the base 416 relative to the arch 426. Also, the crosspiece of the arch 426 will limit the upward movement of the center toe tongue 417.

Moreover, the heel projections or tongues 423 and 424 projecting rearward from the rearward end of the baseplate 416 will limit the transverse movement of the rearward portion of the baseplate by engagement with the posts or legs of the arch and engagement of the arch posts with the bottom of notch 436 will limit rearward movement of the boot 86 sufficiently to prevent the forwardly projecting center toe tongue 417 from being withdrawn from beneath the forward arch 426.

The baseplate 416 of the forward boot and the arch 426 between the boots do not have any provision, however, for preventing the rearward portion of the forward boot baseplate from being raised so that the heel projections or tongues 432 and 434 and the notch 436 will clear the rearward arch 426 to enable the rearward portion of the forward boot baseplate to be swung laterally without interference by the rearward arch 426.

Figure 53:
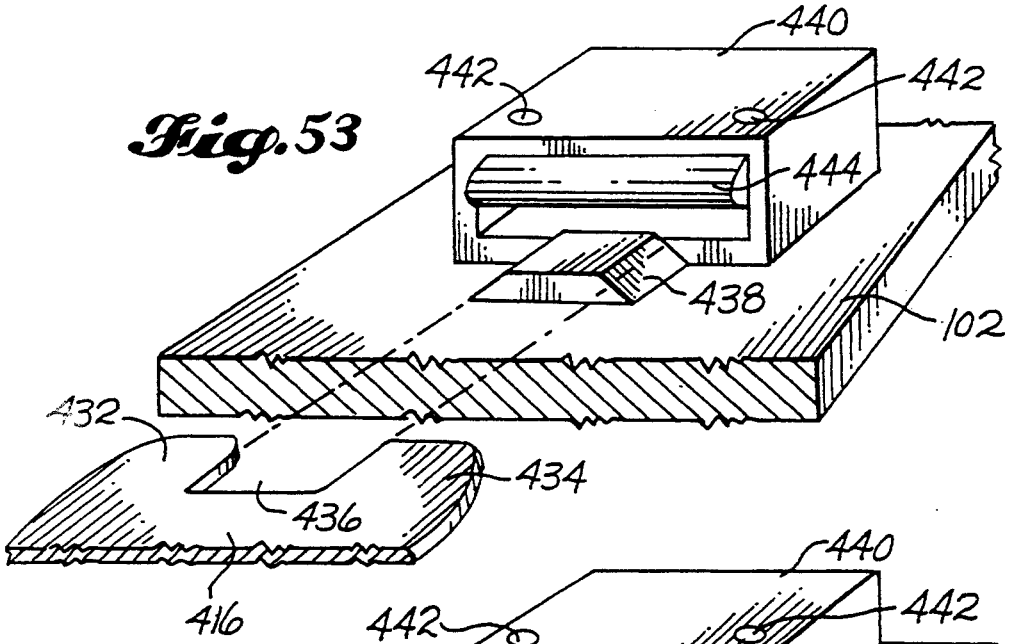
FIG. 53 is a fragmentary top perspective looking rearward of portions of the ski binding shown in FIG. 50 with components shown in separated relationship.

In order to prevent the rearward portion of the forward boot baseplate from being released from the rearward arch 426 in the manner described when the rearward end of the baseplate for the forward boot 86 has been assembled with the arch 426 between the boots, as shown at the left of FIG. 53, the rearward boot 46 on the rear foot of the skier can be manipulated to insert the center toe tongue 417 projecting forwardly from the rearward boot baseplate 416 beneath the rearward loop 426 in the direction indicated by the arrow in FIG. 51 into the position shown in FIG. 52. By thus inserting the toe tongue 417 of the rearward boot baseplate into the rearward arch 426, the side toe projections or tongues 418 and 422 will be fitted over or will overlap the side heel projections or tongues 432 and 434 projecting rearwardly from the rearward end of the forward boot baseplate, as shown in FIG. 52.

The crosspiece of arch 426 overlying center tongue 417 will prevent the side toe tongues 418 and 422 from being lifted to escape over the arch, and such side toe tongues in turn will overlap the heel tongues 432 and 434 of the forward boot baseplate bifurcation to prevent them from rising into a position clear of the arch, so that the loop or arch 426 operatively interconnects or couples the rearward portion of the forward boot baseplate and the forward portion of the rearward boot baseplate. Consequently, by such overlapping engagement of the toe tongues of the rearward boot baseplate with the heel tongues of the forward boot baseplate such rearward boot baseplate and the loop 426 will function as keeper member for the rearward portion of the forward boot baseplate and the forward portion of the rearward boot baseplate as long as the center toe tongue 417 of the rearward boot baseplate is not withdrawn from beneath the loop.

Figure 54:
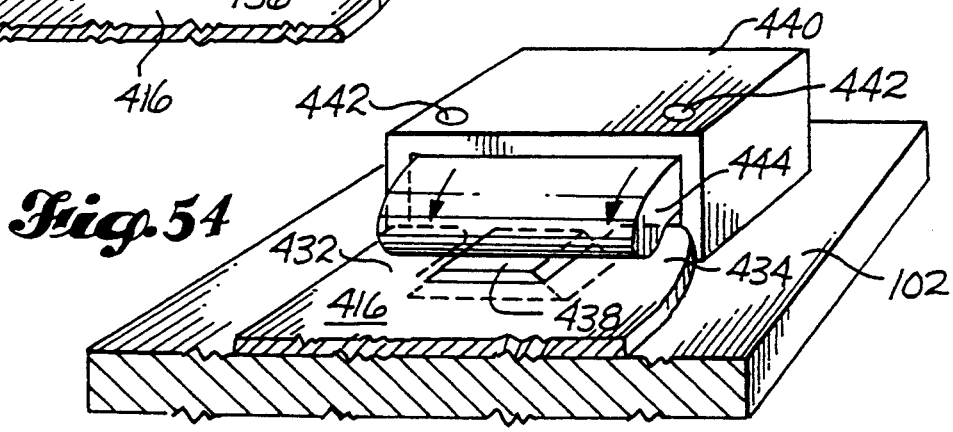
FIG. 54 is a similar view with the components shown in assembled relationship.

The baseplate 416 of the rearward boot 88 can be prevented from being withdrawn from beneath the rearward arch 426 inadvertently by the mechanism shown in FIGS. 53 and 54. Such mechanism includes a centering plate projection 438 upstanding from the ski of a width and having opposite beveled edges to fit into the rearwardly opening and downwardly flaring notch 436 between the rearward projections or heel tongues 432 and 434 of the rearward boot baseplate 416 for forming keeper means. The notch constitutes a socket that can be engaged with the plate 438 merely by the rearward portion of the rearward baseplate 416 being moved downward by the rear foot lodged in the rearward boot 88.

Preferably, the opposite edges of the plate 438 are chamfered to facilitate centering of the plate in the notch 436. Such plate limits edgewise movement of the rearward portion of baseplate 416 transversely of the ski and rearward movement of the baseplate can be limited by the rearward end portions of the heel projections or tongues 432 and 434 engaging the adjacent end of a housing 440 secured to the ski 102 behind the rearward boot 86 by bolts or rivets 442. Upward movement of the rearward portion of the rearward baseplate 416 can be prevented by the projectable tongue 444 of a conventional ski binding being moved forward from the position shown in FIG. 53 to the position shown in FIG. 54, where it overlies the plate 438 and the heel tongues 432 and 434 located at opposite sides of such plate.

The latch will be of a type such that a strong upward wrench of the heel portion of the rearward boot 88 will cause heel tongues 432 and 434 to retract the tongue 444 and free the rearward end portion of the rearward baseplate 416 from such latch. The heel of the rearward boot can then be raised and the rearward boot can be pulled rearwardly to withdraw toe tongue 417 projecting forwardly from the rearward baseplate 416 from beneath the rearward arch or loop 426. Both the rearward and forward portions of the rearward boot 88 will thus be freed for removal of the rearward boot from the ski.

Such withdrawal of the center toe tongue 417 of the rearward boot baseplate 416 would also remove the side toe tongues 418 and 422 of the rearward boot baseplate from their position overlapping and confining the heel projections or tongues 432 and 434 of the forward boot, as shown in FIG. 52. The rearward end portion of the forward boot baseplate 416 will thus be freed so that it can be lifted out of engagement with the rearward arch 426 enabling the entire forward boot 86 to be pulled rearward for withdrawing the center toe tongue 417 of the forward boot from beneath the forward arch 426 to free the forward boot from the ski virtually simultaneously with freeing of the rearward boot from the ski.

Subsequently, as desired, the center toe tongue 417 of the forward boot baseplate can be inserted again beneath the forward arch or loop 426, the heel of the forward boot swung downward so that its heel tongues 432 and 434 would straddle the rearward arch 426, after which the toe tongue 417 projecting forward from the toe portion of the rearward shoe baseplate 416 can be engaged in the manner indicated in FIG. 51 into the position shown in FIG. 52. Then the rearward boot 88 can be swung downward so that its heel projections or tongues 432 and 434 will straddle and fit over the plate 438. The retaining bar 444 of the heel latch can then be rolled forward from the position shown in FIG. 53 to the holding position shown in FIG. 54. Both forward and rearward boots would then be latched to the ski again until the heel portion of the rearward boot is again wrenched sufficiently to effect retraction of the latch bar 444 to the position shown in FIG. 53 which would result in freeing first the rearward boot 88 and then the forward boot 86 substantially simultaneously in the manner described above.

We claim:

1. A releasable ski binding for holding a front foot and a rear foot in tandem arrangement on a single ski comprising, an upright post mounted on the ski, a boot having a short furcated projection forming laterally spaced parallel fingers rigid with and extending forwardly from the boot toe alongside opposite sides of said post for limiting movement of the boot toe transversely of the ski, and means for preventing substantial movement of said projection lengthwise of said post.

2. The ski binding defined in claim 1, in which the furcated projection is a bifurcated projection.

3. The ski binding defined in claim 1, in which the furcated projection is a trifurcated projection forming three laterally-spaced parallel fingers and two forwardly opening notches, and a loop including two legs forming two posts received respectively in said two notches of said trifurcated projection with said fingers extending forwardly from the boot toe along opposite sides of said two posts and the means for preventing appreciable movement of the projection lengthwise of the posts is a crosspiece connecting the upper ends of said legs.

4. The ski binding defined in claim 3, in which the center furcation of the trifurcated projection forming the central finger is insertable into the loop between its two legs and under its crosspiece.

5. A releasable ski binding for holding a front foot and a rear foot in tandem arrangement on a single ski, comprising a boot having a heel projection member with a downwardly-opening socket, and a cooperating member rigidly mounted on and upstanding from the ski, for entry into said socket by movement of the heel of said boot downward relative to the ski.

6. The ski binding defined in claim 5, in which the socket opens rearwardly and downwardly from the heel.

7. A releasable ski binding for holding a front foot and a rear foot in tandem arrangement on a single ski, comprising a boot having a heel member, a cooperating member mounted on the ski, one of said members having a projection and the other of said members having a recess engageable by said projection, and pivot means supporting said member mounted on the ski for swinging to engage or to disengage said projection and said recess.

8. The ski binding defined in claim 7, and resilient means for pressing toward the boot heel the swingable member mounted on the ski.

9. The ski binding defined in claim 8, and foot-engageable means separate from the boot and operable to alter the force of the resilient means toward the boot heel.

10. The ski binding defined in claim 9, and a treadle pivotally mounted on the ski constituting the foot-engageable means separate from the boot.

11. The ski binding defined in claim 9, in which the foot-engageable means is movable relative to the swingable member mounted on the ski, and the resilient means is interengaged between the separate foot-engageable means and the swingable member mounted on the ski.

12. The ski binding defined in claim 11, in which the resilient means includes a helical compression spring.

13. The ski binding defined in claim 12, in which the resilient means includes a rod extending through the helical compression spring.

14. The ski binding defined in claim 6, and a plate upstanding from the ski having opposite beveled edges and constituting the projection engageable with the socket.

15. A releasable ski binding comprising for holding boots a front foot and a rear foot, respectively in tandem arrangement on a ski, the end of one boot carrying a heel projection and the adjacent end of the other boot carrying a toe projection, said heel projection and said toe projection being constructed and arranged for one of said projections to engage the other of said projections for holding to the ski the end of the boot carrying said other projection.

16. A releasable ski binding for holding a front foot and a rear foot in tandem arrangement on a single ski, comprising two boots for holding the respective feet, one of said boots having a projecting member carried by an end of such boot, and a cooperating member mounted on the ski and having a socket engageable by said projecting member to limit movement of such end of said one boot relative to the ski independently of the other of said boots.

17. The ski binding defined in claim 16, in which the projecting member projects forwardly from the boot toe and the cooperating member mounted on the ski has a rearwardly opening socket for receiving said forwardly projecting projection.

* * * * *

UNITED STATES PATENT AND TRADEMARK OFFICE

CERTIFICATE OF CORRECTION

PATENT NO. : 5,368,320

DATED : November 29, 1994

INVENTOR(S) : Teeter et al

It is certified that error appears in the above-indentified patent and that said Letters Patent is hereby corrected as shown below:

| COLUMN | LINE | |
|---|---|---|
| 1 | 25 | "i f" should read --if-- |
| 3 | 14 | "invent ion" should read --invention-- |
| 7 | 16 | After "arm" (first occurrence) insert --230-- |
| 10 | 62 | "member" should read --means-- |
| 11 | 32 | After "sides" insert --of-- |
| 11 | 34-35 | "or shank post 396" should read --post or shank 396-- |

UNITED STATES PATENT AND TRADEMARK OFFICE

CERTIFICATE OF CORRECTION

PATENT NO. : 5,368,320

DATED : November 29, 1994

INVENTOR(S) : Teeter et al

It is certified that error appears in the above-indentified patent and that said Letters Patent is hereby corrected as shown below:

| Column | line | |
|---|---|---|
| 13 | 3 | "member" should read --means-- |
| 14 (Claim 1, | 17-18 lines 2-3) | "ski comprising," should read --ski, comprising-- |
| 14 (Claim 6, | 52 line 3) | Before "heel" insert --boot-- |
| 15 (Claim 15, | 18-19 lines 1-2) | "binding comprising for holding boots" should read --binding comprising boots for holding-- |
| 15 (Claim 15, | 19 line 2) | After "respectively" insert --,-- |

Signed and Sealed this

Twenty-fifth Day of April, 1995

*Attest:*

Bruce Lehman

BRUCE LEHMAN

*Attesting Officer*

*Commissioner of Patents and Trademarks*